United States Patent [19]

Petak et al.

[11] Patent Number: 4,797,821

[45] Date of Patent: Jan. 10, 1989

[54] METHOD OF ANALYZING NATURALLY FRACTURED RESERVOIRS

[75] Inventors: Kevin R. Petak, Duncan; Mohamed Y. Soliman, Lawton; Merlin F. Anderson, Duncan, all of Okla.

[73] Assignee: Halliburton Company, Duncan, Okla.

[21] Appl. No.: 34,441

[22] Filed: Apr. 2, 1987

[51] Int. Cl.[4] ..... E21B 49/00; E21B 47/00

[52] U.S. Cl. ..... 364/422; 73/55

[58] Field of Search ..... 364/422; 73/55; 324/323

[56] References Cited

U.S. PATENT DOCUMENTS

| | | | |
|---|---|---|---|
| 4,442,710 | 4/1984 | Meng | 73/155 |
| 4,597,290 | 7/1986 | Bourdet et al. | 73/155 |
| 4,607,524 | 5/1982 | Gringarten | 73/155 |

OTHER PUBLICATIONS garwal, "A New Method to Account for Producing Time Effects When Drawdown Type Curves are Used to Analyze Pressure Buildup . . . ", SPE-9289 (1980).

Bourdet and Gringarten, "Determination of Fissure Volume and Block Size in Fractured Reservoirs by Type Curve Analysis", SPE 9293 (1980).

Bourdet, Ayoub and Pirard, "Use of Pressure Derivative in Well Test Interpretation", SPE-12777 (1984).

Bourdet, Whittle, Douglas, and Pirard, "A New Set of Type Curves Simplifies Well Test Analysis", World Oil (May 1983) 95-106.

DeSwaan, "Analytic Solutions for Determining Naturally Fractured Reservoir Properties . . . ", *Society of Petroleum Engineers Journal* (Jun. 1976) 117-22.

Puthigai, "Application of $P'_D$ Function to Vertically Fractured Wells—Field Cases", SPE 11028 (1982).

Reynolds, Chang, Yeh and Raghavan, "Wellbore Pressure Response in Naturally Fractured Reservoirs", J. Petroleum Technology (May 1985) 908-920.

Serra, Reynolds and Raghavan, "New Pressure Transient Analysis Methods for Naturally Fractured Reservoirs", *J. Petroleum Technology* (Dec. 1983) 2271-2284.

Stehfest, "Algorithm 368 Numerical Inversion of Laplace Transforms", *Communication of the ACM* (Vol. 13, No. 1, Jan. 1970) 47.

Tiab and Kumar, "Application of the $p'_D$ Function to Interference Analysis", *J. Petroleum Technology* (Aug. 1980) 1465-1417.

Tiab and Kumar, "Detection and Location of Two Parallel Sealing Faults Around a Well", *J. Petroleum Technology* (Oct. 1980) 1701-1708.

Warren and Root, "The Behavior of Naturally Fractured Reservoirs", *Society of Petroleum Engineers Journal* (Sep. 1963) 245-255.

*Primary Examiner*—Joseph Ruggiero
*Assistant Examiner*—Gail O. Hayes
*Attorney, Agent, or Firm*—Robert A. Kent

[57] ABSTRACT

Determining pressure characteristics of fluid flow from a wellbore provides a method to obtain physical characteristics of a subterranean reservoir. An analytical solution of flow a flow model for an underground dual porosity reservoir is obtained for the transient flow regime of an unsteady flow exhibiting wellbore storage and skin effects. Using either the continuous solution or a set of type curves obtained from that continuous solution, a match is obtained with an experimental data set. The first time derivative of the dimensionless pressure solution to the flow model can also be used to more easily identify the dimensionless time at which the transient period ends. Using classical relationships between known values and information obtained from the type curves, the effective permeability, dimensionless fracture transfer coefficient, the skin factor, the dimensionless wellbore storage coefficient, and the dimensionless storativity ratio can be ascertained for the underground formation.

22 Claims, 15 Drawing Sheets

METHOD OF ANALYZING NATURALLY FRACTURED RESERVOIRS

BACKGROUND OF THE INVENTION

The present invention relates generally to a method of analyzing the characteristics of an underground reservoir. More particularly, the present invention deals with a method of reservoir analysis which utilizes type curve analyses.

In the petroleum industry, it is desirable to know many of the characteristics of the subterranean reservoir from which crude petroleum is being produced. These characteristics make it possible to predict with greater accuracy the length of time that a particular formation will produce and the volume of production that can be expected from that well during that period of time.

Many various theoretical models for underground reservoir formations have been developed by persons in the petroleum industry as well as others having an interest in the theory of reservoir fluid flows. The theoretical models of the past have been of significant value in beginning the systematic evaluation and analysis of existing wells as well as new wells. One of the important contributions of these various systematic analyses has been the development of type curves as a mechanism for determining reservoir characteristics.

Type curves are created in a dimensionless form for a particular theoretical model. Frequently, wellbore pressure is divided by the product of a group of reservoir parameters having the dimensions of pressure to obtain a dimensionless pressure. In similar fashion, time is divided by the product of a different group of reservoir parameters having dimensions of time to obtain a dimensionless time. The dimensionless pressure is graphically expressed as a function of the dimensionless time on the type curve while one or more other groups of reservoir parameters are held constant. In some analyses, the logarithm of dimensionless pressure and the logarithm of dimensionless time are presented in graphic form as the type curve.

Measurement data are then taken of particular characteristic parameters such as wellbore pressure as a function of time. Alternatively, the measurement data may represent data which had been takn at an earlier time. In both cases, the data are plotted in a particular form to a predetermined scale. When the plotted data is compared to the theoretical type curves by overlaying the plotted data on the theoretical type curve, information on the reservoir characteristics can be determined from the type curve which is most similar to the experimental data and, in some cases, from the displacement of the ordinate and abscissa of the experimental data from the ordinate and abscissa of the theoretical type curve.

Initially, the theoretical models used for the underground reservoir were relatively limited by current standards. An early concept on the pressure transient behavior of dual porosity media was presented by G. E. Barenblatt, I. P. Zheltov and I. N. Kochina, "Basic Concepts in the Theory of Homogeneous Liquids in Fissured Rocks", *J. Applied Mathematical Mechanics* (USSR) 24 (5) (1960) 1286-03. An idealized model representing flow in a naturally fractured (or vugular) reservoir was presented by J. E. Warren and P. J. Root, "The Behavior of Naturally Fractured Reservoirs", *Society of Petroleum Engineering Journal,* (Sept. 1963) 245-55; Transactions, AIME, 228. Warren and Root observed that the pressure behavior of a well producing from a dual porosity reservoir is influenced by two parameters, lambda and omega. These two parameters provide a measure of the fractures relative to the total volume and a measure of the production from the matrix. The Warren and Root mathematical model implies pseudo-steady state interaction between fractures and matrix in the underground formation. Such pseudo-steady state interaction results in an instantaneous pressure drop throughout the matrix when the fractures are depleted. Clearly, such a pseudo-steady state interaction does not closely resemble the natural effect of fracture depletion, namely, gradual pressure reduction.

The Warren and Root analysis has been followed by others working in the field of reservoir analysis. For example, the Warren and Root analysis is followed by D. Bourdet and A. C. Gringarten, "Determination of Fissure Volume and Block Size in Fractured Reservoirs by Type Curve Analysis", SPE 9293 presented at 1980 SPE Annual Technical Conference and Exhibition, Dallas, September 21-24. Type curves developed by Bourdet and Gringarten allow analysis of transient data from naturally fractured reservoirs.

In addition to the use of a dimensionless pressure, the first derivative of the dimensionless pressure taken with respect to dimensionless time has been used as a type curve in a pseudo-steady state reservoir analysis, see D. Bourdet, J. A. Ayoub, and Y. M. Pirard, "Use of Pressure Derivative in Well Test Interpretation", SPE 12777 (April 11-13, 1984). See also D. Bourdet, T. Whittle, A Douglas, and Y. M. Pirard, "New Type-Curves for Tests of Fissured Formations", *World Oil* (April 1984); U.S. Pat. No. 4,597,290.

The first derivative of dimensionless pressure taken with respect to dimensionless time has been used as a discriminant in reservoir analysis for quite some time. For example, D. Tiab and A. Kumar, "Application of the $P'_D$ Function to Interference Analysis", *J. Petroleum Technology* 1465-70 (August 1980) (dimensionless pressure derivative used in well interference analysis); S. K. Puthigai, "Application of $P'_D$ Function to Vertically Fractured Wells—Field Cases", SPE 11028 (Sept. 26-29, 1982) (dimensionless pressure derivative used for vertically fractured wells); D. Tiab and A. Kumar, "Detection and Location of Two Parallel Sealing Faults Around a Well", *Journal of Petroleum Technology* 1701-08 (October 1980) (dimensionless pressure derivative used for locating well relative to vertical fluid barriers).

Even when the pseudo-steady state model is modified to accommodate wellbore storage and skin effects, the resulting type curves are not entirely adequate. For example, the assumption of pseudo-steady state permits some of the interactive effects to be decoupled from other effects. This facet of the problem can be seen from the type curves used in U.S. Pat. No. 4,597,290 to Bourdet et al. In the Bourdet et al patent, not only are there a set of type curves for the dimensionless pressure derivative, there are two additional sets of type curves superimposed on the dimensionless pressure derivative curves that are necessary to determine the formation porosity characteristics of lambda and omega.

A mathematical model which does not suffer from an instantaneous pressure drop throughout the matrix when the fractures are depleted has been proposed by O. A. DeSwaan, "Analytical Solutions for Determining Naturally Fractured Reservoir Properties by Well Testing", *Society of Petroleum Engineers Journal,* 117-22 (December 1969), and extended by K. V. Serra, A. Reynolds, and R. Raghavan, "New Pressure Transient Analysis Methods for Naturally Fractured Reservoirs", *J. Petroleum Technology* 2271-83 (Dec. 1983). The DeSwaan model provides an unsteady state interaction between the matrix and the fractures. In such an interaction, pressure response throughout the matrix occurs transiently as the fractures are depleted.

In real wells, however, there are additional characteristics which affect the pressure response as a function of time. For example, when a well is drilled, the drilling mud tends to clog the porous structure immediately adjacent to the wellbore. That clogging is known in the industry as a skin effect. This skin effect is localized to the immediate vicinity of the wellbore itself and has the effect of creating resistance to the flow of fluid being produced.

Another aspect of real wells is known in the industry as the wellbore storage effect. This effect is a result of fluid loading, unloading, compressing, and/or expanding in the wellbore following a change to the production flow rate. This effect becomes more significant in well tests where the placement of the valve controlling fluid flow is at the surface.

It should now be apparent that there continues to be a need for a method of analyzing the transient behavior of underground reservoirs which compensates for effects such as wellbore storage, skin effects, double porosity reservoirs, and which accomplishes these things using an unsteady analysis scheme.

SUMMARY OF THE INVENTION

An analytical solution to the flow in an underground reservoir is made which accounts for wellbore storage, skin effect, and double porosity of the producing formation in an unsteady flow model. Recognizing that the flow from an underground reservoir can be conveniently broken into an early time radial flow portion, a transition flow portion, and a late time radial flow portion, a simplification can be made to the analytical solution so that it approximates the early time radial flow and the transition flow portions.

The resulting analytical solution represents an unsteady flow model and expresses the dimensionless pressure as a set of three-dimensional surfaces with (a) dimensionless time and (b) a first dimensionless parameter, $C_De^{2S}$ as the axes defining a plane, and a second dimensionless parameter being constant on each of the surfaces. The second dimensionless parameter is the product of the dimensionless storativity ratio, the dimensionless fracture transfer coefficient, and $e^{-2S}$. The first derivative of the dimensionless pressure taken with respect to dimensionless time may also be expressed as a second set of three dimensional surfaces, one for each constant value of the second dimensionless parameter with dimensionless time, and the first dimensionless parameter, $C_De^{2S}$, as the axes defining a plane.

To condense representation of the first set of surfaces, the dimensionless time can be scaled by $1/C_D$. Correspondingly, to condense representation of the second set of surfaces, the derivative can be taken with respect to the ratio of dimensionless time to the dimensionless wellbore storage coefficient, and the result can be scaled by the factor $t_D/C_D$, with the dimensionless time being scaled by $1/C_D$. Both the first set of surfaces and the second set of surfaces can be further condensed by expressing their respective axes as logarithms.

If desired, the transient analytical solution for the dimensionless pressure and the first time derivative of the dimensionless pressure can be presented as a first series and a second series of graphs, respectively, which represent slices taken through the surfaces for constant values of the first parameter, $C_De^{2S}$.

Actual data representing pressure differential as a function of time are compared with the analytical solution to obtain the closest match for early values of dimensionless time. From the comparison, the value of the dimensionless time at which there is a departure from the transition flow approximation can be determined, the dimensionless group, $C_De^{2S}$, is known, and the second dimensionless group, $\omega'\lambda'e^{-2S}$, is known. When the actual data departs from the transition flow approximation, the end of the transition flow period is determined.

Knowing (a) the dimensionless time at which the transition flow period ends, and (b) the corresponding values of the first and second dimensionless groups, the dimensionless storativity ratio, $\omega'$, the dimensionless fracture transfer coefficient, $\lambda'$, the effective permeability, k, the skin factor, S, the wellbore storage constant, C, and the dimensionless wellbore storage coefficient, $C_D$, of the formation can be determined.

To enhance the precision of determining the dimensionless time at the end of the transition period, the time-rate-of-change of the measured pressure differentials with respect to time can also be compared with the first time derivative of the dimensionless pressure. The derivative is more sensitive to the changes and permits a more discriminating selection of the proper dimensionless time.

BRIEF DESCRIPTION OF THE DRAWINGS

Many objects and advantages of the present invention will be apparent to thos skilled in the art when this specification is read in conjunction with the attached drawings wherein like reference numerals are applied to like elements and wherein.

DESCRIPTION OF THE PREFERRED EMBODIMENTS

Figure 1:
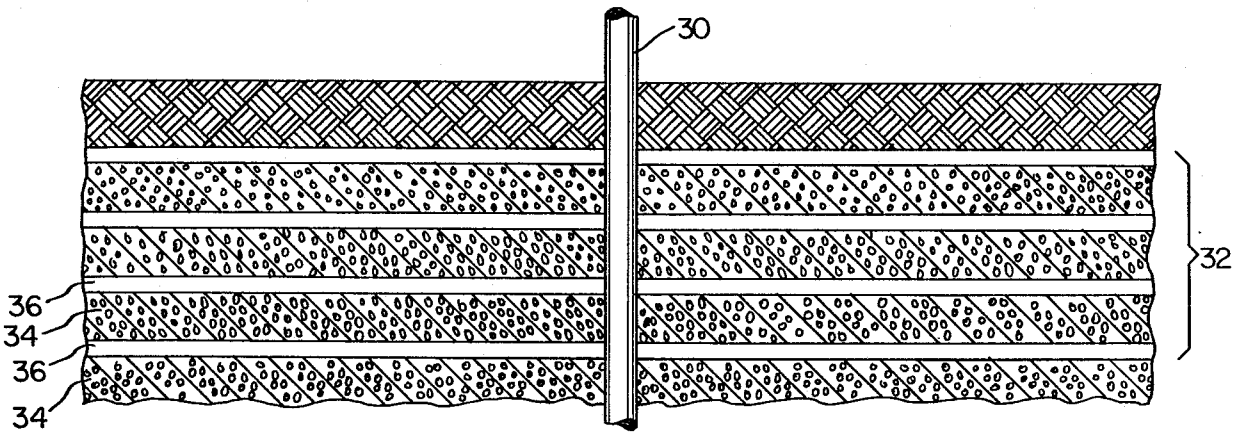
FIG. 1 is a schematic illustration of a wellbore traversing an underground formation.

In a typical underground formation producing hydrocarbons, there is wellbore 30 (see FIG. 1) traversing the formation 32 through which the fluid is produced. By virtue of the drilling operation which establishes the wellbore, drilling mud tends to partially plug the formation in a region immediately adjacent to the wellbore. This phenomenon is referred to as a skin effect.

Another common characteristic of production from underground reservoirs is known as wellbore storage.

This effect is a result of fluid loading, unloading, compressing and/or expanding in the wellbore following a change to the production rate. This effect becomes more significant in well tests where the placement of the valve controlling fluid flow is at the surface end of the wellbore.

Many parameters of the reservoir are determined when the well is drilled. For example, the formation volume factor, B, the fluid viscosity, $\mu$, the formation thickness, h, the connected porosity, $\phi$, the total compressibility, $c_t$, and wellbore radius, $r_w$, are ordinarily known for a particular well. To reliably analyze an underground reservoir, the characteristics of wellbore storage and skin effect must be taken into consideration. However, to analyze a reservoir, there is only a limited amount of data that will ordinarily be available. During typical well tests, fluid pressure in the wellbore is measured at the depth of the producing formation for successive periods along with the associated fluid flow rate; simultaneously, fluid flow rates from the wellbore are measured. Generally these sets of experimental data are obtained by adjusting or changing flow area of the wellbore to change the rate of flow of fluid from the wellbore. Then pressure, flow rate and time measurements are taken.

To have a reliable analysis of the reservoir, there must be an analytical model which behaves sufficiently like the physical response of a typical reservoir and which accounts for the types of reservoir behavior which have been observed in the past.

Figure 2:
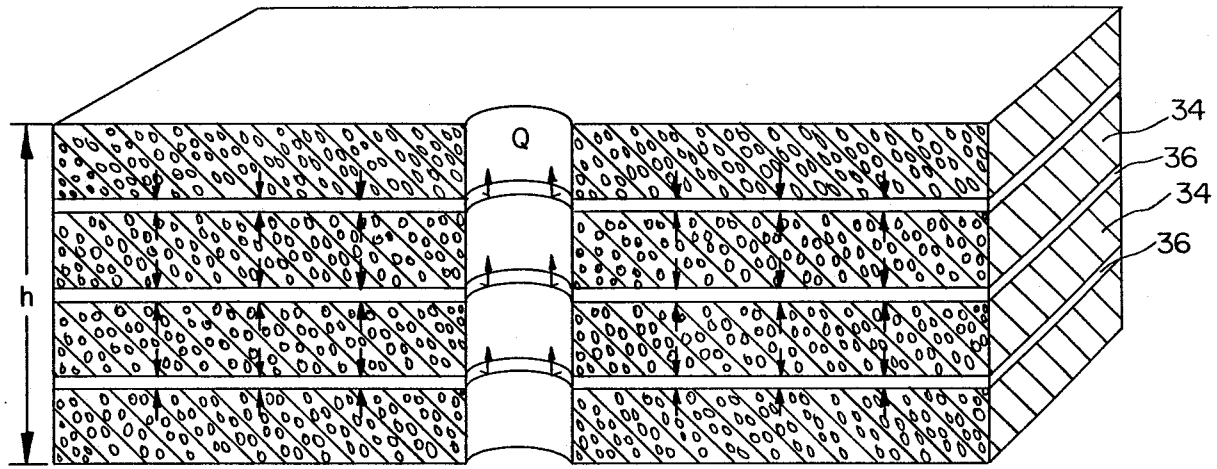
FIG. 2 is a schematic illustration of the structure assumed to exist in the underground reservoir.

Thus, fundamental to an understanding of the analytical method of the present invention and its limitations is an understanding of the development of the equations governing fluid flow in a typical underground reservoir formation. To this end, the mathematical model which is assumed to describe the flow conditions in the underground reservoir are as follows:

(a) the reservoir fluid is slightly compressible and has a constant viscosity which is independent of pressure changes in the reservoir;
(b) the reservoir itself is isotropic, naturally fractured, and has a uniform thickness;
(c) the structure of the reservoir consists of horizontal slabs of matrix 34 (see FIG. 2) divided by a set of parallel fractures 36 (commonly referred to as the hoizontal fracture model), the matrix as well as the fractures being homogeneous;
(d) fluid flow in the matrix is one dimensional in the direction normal to the plane of the fractures;
(e) all fluid produced from the reservoir comes from the fractures and fluid is produced at a constant rate;
(f) a thin skin region exists around the wellbore;
(g) wellbore storage effects are present; and
(h) effects of gravity are negligible.

The phrase "dual porosity" is used in the literature to describe the porosity present in naturally fractured formations, formations with layers having contrasting permeability, jointed formations, vugular formations, and the like. Thus, the mathematical model described above is a dual porosity model.

A mathematical model which accounts for items (a) through (e) and (h) has been developed by Serra et al in their paper "New Pressure Transient Analysis Methods of Naturally Fractured Reservoirs", *Journal of Petroleum Technology* (Dec. 1983) 2271-83. The governing differential equation for unsteady state flow in a naturally fractured reservoir is expressed as follows:

$$\frac{\partial^2 P_{Df}}{\partial r_D^2} + \frac{1}{r_D}\frac{\partial P_{Df}}{\partial r_D} - \left(\frac{\partial P_{Df}}{\partial t_D} + \frac{\lambda' \partial P_{Dm}}{3\partial Z_D}\Big|_{Z_D=1}\right) = 0 \quad [1]$$

where:

$r_D$ is the dimensionless radius measured from the wellbore;
$z_D$ is the dimensionless vertical distance, the actual vertical distance divided by one half the thickness of the matrix slab;
$t_D$ is the dimensionless time;
$P_D$ is the dimensionless wellbore pressure with $P_{Df}$ being the dimensionless pressure in the fracture and $P_{Dm}$ being the dimensionless pressure in the matrix; and
$\lambda'$ is the dimensionless fracture transfer coefficient.

At the beginning of any flow, it is assumed that the dimensionless pressure in the fractures is stable and uniform. In addition, it is assumed that, at great distances from the wellbore, the dimensionless pressure in the fractures does not change.

These two assumptions are mathematically expressed, respectively, as follows and represent boundary conditions which the partial differential equation of the mathematical model, i.e., Equation [1], must satisfy:

$$P_{Df}\big|_{t_D=0} = 0 \quad [2]$$

$$\lim_{r_D \to \infty} P_{Df=0} \quad [3]$$

The wellbore storage effect occurs at the wellbore itself and can be accounted for by recognizing that wellbore flow at the surface has two components, actual flow from the fracture and actual flow from the wellbore storage effect. However, the actual flow from wellbore storage is proportional to the derivative of dimensionless wellbore pressure taken with respect to dimensionless time. Moreover, the flow from the fracture is proportional to the radial gradient of the dimensionless pressure in the fracture determined at the wellbore. Mathematically, the wellbore storage effect also represents a boundary condition on the partial differential equation describing flow conditions in the reservoir and can be expressed as follows:

$$C_D \frac{d P_{DW}}{d t_D} - \frac{\partial P_{Df}}{\partial r_D}\Big|_{r_D=1} = 1 \quad [4]$$

where:

$C_D$ is the dimensionless wellbore storage coefficient;
$P_{Dw}$ is the dimensionless pressure in the wellbore; and
$P_{Df}$ is the dimensionless pressure in the fracture.

The remaining boundary condition for the partial differential equation for flow in the fracture accounts for the skin effect. Physically, the skin effect represents a change in the dimensionless pressure measured in the wellbore compared to that dimensionless pressure which would be predicted based solely on the pressure in the fracture at the location of the wellbore. Mathematically, the boundary condition can be expressed as follows:

$$P_{Dw} = \left[ P_{Df} - S \frac{\partial P_{Df}}{\partial r_D} \right]_{r_D=1} \quad [5]$$

where: S is the skin factor.

It will be seen from Equation [1] that the dimensionless pressure in the fracture, $P_{Df}$, is related to the dimensionless pressure in the matrix, $P_{Dm}$. For a horizontal slab type model, Serra et al used Laplace transforms on the time variable to express the relationship of Equation [1] mathematically in terms of a Laplace transforms of the dimensionless pressures as follows:

$$P_{Dm} = P_{Df} \frac{\cosh[Z_D \sqrt{(\omega' u/\lambda')}]}{\cosh[\sqrt{(3\omega' u/\lambda')}]} \quad [6]$$

where:

the overbars indicate Laplace transforms of the corresponding variables discussed above;

u is the Laplace variable; and $\omega'$ is the dimensionless storativity ratio for the matrix.

By performing a Laplace transformation of the time variable of Equation [1], the last term can then be expressed in terms of other physical parameters of the system by differentiating Equation [6] and evaluating the result for $z_D=1$. The resulting equation is expressed as follows:

$$\frac{\partial^2 P_{Df}}{\partial r_D^2} + \frac{1}{r_D} \frac{\partial P_{Df}}{\partial r_D} - [u + \sqrt{(\omega'\lambda' u/3)} \tanh \sqrt{(3\omega' u/\lambda')}] P_{Df} = 0 \quad [7]$$

Equation [7] is a form of Bessel's equation which has the following general solution:

$$PDf = A_1 I_0(r_D x) + A_2 K_0(r_D x) \quad [8]$$

where:

$A_1$ and $A_2$ are constants selected to satisfy the boundary conditions;

$I_0(r_D x)$ is a modified Bessel function of the first kind of zero order;

$K_0(r_D x)$ is a modified Bessel function of the second kind of zero order; and x is given by the following expression:

$$x = \sqrt{[u + \sqrt{(\omega'\lambda' u/3)} \tanh \sqrt{(3\omega' u/\lambda')}]} \quad [9]$$

By performing Laplace transformations of Equations [2–5] with respect to the dimensionless time, $t_D$, the constants $A_1$, $A_2$ in Equation [8] can be determined so that the boundary conditions expressed in Equations [2–4] will be satisfied. Then, from Equation [5], the Laplace transform of the dimensionless pressure in the wellbore can be determined. The resulting relationship is given below:

$$P_{Dw} = \frac{1}{u} \left\{ \frac{K_0(x) + S \times K_1(x)}{x K_1(x) + C_D u[K_0(x) + S \times K_1(x)]} \right\} \quad [10]$$

where:

$P_{Dw}$ is the Laplace transform of the dimensionless pressure in the wellbore;

u is the Laplace variable;

$K_0(x)$ is the modified Bessel function of the second kind of order zero for the argument x;

$K_1(x)$ is the modified Bessel function of the second kind of order one for the argument x;

S is the skin factor;

$C_D$ is the dimensionless wellbore storage coefficient; and x is given by Equation [9] above.

Even though Equation [10] is still expressed in the Laplace variable domain, it is possible to further simplify it. Further simplification is attained by recognizing that any wellbore with a finite wellbore radius, $r_w$, and a finite skin factor, S, can be replaced by an equivalent wellbore radius, $r_w'$, having a skin factor of zero. The relationship between the wellbore radius and the equivalent wellbore radius is given by:

$$r_w' = r_w e^{-S}$$

Since the equivalent dimensionless fraction transfer coefficient varies directly as the square of the equivalent wellbore radius, $r_w'$, the equivalent dimensionless fraction transfer coefficient varies from values based on the actual wellbore radius by the factor $e^{-2S}$. In addition, since the dimensionless wellbore storage coefficient varies inversely as the equivalent wellbore radius, $r_w'$, the equivalent wellbore storage coefficient, $C_D'$ can be replaced by $C_D e^{2S}$. In a similar vein, it can be shown that other parameters of Equation [10] can be expressed as equivalent parameters according to the following relationships:

$$u' = u e^{-2S};$$

$$x' = x e^{-S};$$

$$(\omega'\lambda')_{eq} = \omega'\lambda' e^{-2S}; \text{ and}$$

$$\lambda' = \lambda' e^{-2S}.$$

The dimensionless storativity ratio $\omega'$ is the same in either the actual system or the equivalent system.

Using the foregoing equivalences for equivalent systems, Equation [10] can be xpressed for the equivalent system as:

$$P_{Dw} = \frac{1}{u'} \frac{K_0(x')}{x' K_1(x') + C_D' u' K_0(x')} \quad [11]$$

where the parameter x' now has the value:

$$x = \sqrt{u' + \sqrt{(\omega'\lambda')_{eq} u'/3)} \tanh \sqrt{(3\omega' u'/\lambda'_{eq})}} \quad [12]$$

The expressions of Equations [11] and [12] do not explicitly have the skin factor, S, as a parameter. However, the solution of those equations which gives $P_D$ as a function of $t_D/C_D$ will also be a function of $C_D'$ and $(\omega'\lambda')_{eq}$, which are $C_D e^{2S}$ and $\omega'\lambda' e^{-2S}$, respectively.

The general solution of the analytical model assumed to predict behavior of the underground formation is thus provided by Equations [11] and [12].

Empirically, the behavior of dimensionless pressure in the wellbore is known to have three distinct periods.

See for example, Serra et al above, and Reynolds et al, "Wellbore Pressure Response in Naturally Fractured Reservoirs", *Journal of Petroleum Technology,* 908–20 (May 1985). In the first period known as the early time radial flow period, the wellbore storage effects often dominate the behavior of the dimensionless wellbore pressure. In the second period known as the transition period, the principal effect on the dimensionless pressure behavior is due to transient interaction between the fractures and the matrix. In the third period known as the late time radial flow period, pressure at the matrix-fracture interface stabilizes and the behavior of the dimensionless wellbore pressure is due to production from the matrix-fracture interface.

It has been determined that the hyperbolic tangent function in Equation [12] does not affect the dimensionless wellbore pressure behavior until the beginning of the latetime radial flow period. Accordingly, an approximation to the dimensionless wellbore pressure behavior for the early time radial flow period and for the transition period can be obtained from Equation [11] when the argument of the modified Bessel functions is given as follows:

$$x' = \sqrt{[u' + (\omega'\lambda')_{eq}u'/3)]} \quad [13]$$

In a homogeneous formation, the product of the dimensionless fracture transfer coefficient and the dimensionless storativity ratio is zero. Accordingly, Equation [12] reduces to $$x' = \sqrt{u'}. \quad [14]$$

When Equation [11] is solved for the condition of Equation [14], the resulting analytical solution also corresponds to the condition of pure radial flow, i.e., there is no intermediate transition period between the early time radial flow period and the late time radial flow period. Thus, the pure radial flow condition is a special case of the generalized solution of Equations [11] and [12].

Even though Equations [11, 13, and 14] represent a prediction for behavior of the dimensionless wellbore pressure, that prediction is expressed in the Laplace variable domain which does not have a readily apparent physical significance. From the basic assumptions concerning a suitable analytical model, there are several variables which can be expected to have an influence on the dimensionless wellbore pressure, namely, the dimensionless storativity ratio, $\omega'$, the dimensionless fracture transfer coefficient, $\lambda'$, the skin factor, S, and the wellbore storage coefficient, $C_D$.

An examination of Equation [13] indicates that, in the solution, the dimensionless fracture transfer coefficient, $\lambda'$, the dimensionless storativity ratio, $\omega'$, and the skin factor, S, appear as a group of dimensionless parameters in the form $\omega'\lambda'e^{-2S}$. Likewise, examination of Equation [11] shows that the dimensionless wellbore storage coefficient, $C_D$, and the skin factor, S, appear as another group of dimensionless parameters in the form $C_De^{2S}$. As a result of these observations, the two groups of dimensionless parameters can be selected as constants when the general solution is inverted from the Laplace domain to the dimensionless time domain.

Numerical techniques exist for inverting Laplace transforms. For example, see Stehfest, "Algorithm 368 Numerical Inversion of Laplace Transforms" *Communications of the ACM,* Vol. 13, No. 1 (Jan. 1970). Using such a technique, it is therefore possible to invert Equation [11] for the transition period for homogeneous reservoirs as well as for heterogeneous reservoirs. As a result of such a numerical inversion, the dimensionless pressure, $P_D$, is expressed as a function of (a) the dimensionless time, $t_D$, (b) the first dimensionless parameter group, $C_De^{2S}$, and (c) the second dimensionless parameter group, $\omega'\lambda'e^{-2S}$.

Since the first dimensionless group, $C_De^{2S}$, has been used in the past to distinguish type curves from one another, it is used along with dimensionless time, $t_D$, as two of the independent variables for the inversion. The second dimensionless group, $\omega'\lambda'e^{-2S}$, is held constant. Thus, when Equation [11] is inverted from the Laplace domain to the real time domain, the inversion is performed with dimensionless pressure being the dependent variable such that surfaces having constant values of the second dimensionless group result.

To determine the appropriate ranges of these two dimensionless groupings of independent variables, samples of well test analyses were examined. From that sampling process, it was determined that the dimensionless fracture transfer coefficient, $\lambda'$, typically ranges between $10^{-1}$ and $10^{-9}$, and that the dimensionless storativity ratio, $\omega'$, typically ranges between 1 and $10^4$. Accordingly the second dimensionless grouping will tend to lie between $10^3$ and $10^{-9}$. When the first dimensionless grouping, $C_De^{2S}$, has a value less than 0.5, the reservoir does not behave like the dual porosity model which is involved here. When the first dimensionless grouping, $C_De^{2S}$, exceeds $10^{10}$ the transition from the transient flow regime to the late time radial flow regime is obscured by wellbore storage effects. Accordingly, the practical limits of the first dimensionless grouping, $C_De^{2S}$, are 0.5 and $10^{10}$.

When the numerical inversion of the solution to the boundary value problem in the Laplace domain is accomplished, the dimensionless pressure can be graphically shown as a series of continuous surfaces above a plane bounded by dimensionless time on one axis and the first dimensionless parameter group, $C_De^{2S}$, as the second axis, the second dimensionless parameter group (i.e., the product of the dimensionless storativity ratio, the dimensionless fracture transfer coefficient, and $e^{-2S}$) being a constant on each surface. If desired, the logarithms of the dependent variable as well as of the independent variables can be used to graphically depict the surfaces. Two of the surfaces, 40 and 42, of the dimensionless pressure solution are illustrated in schematic form in FIG. 3. It will be seen from FIG. 3 that the analytical solution for the dimensionless pressure, $P_D$, is a function of three independent variables:

$$P_D = P_D(t_D/C_D,\ C_De^{2S},\ \omega'\lambda'e^{-2S}).$$

It is also possible to present the inversion of the solution to the boundary value problem as a series of type curve sets, each set having a constant value of $C_De^{2S}$, with each curve of the set having a different value for the second dimensionless parameter group. Such a series of type curves may also be obtained by taking cross sections through the set of surfaces for selected values of the first dimensionless parameter group. Such a series of curves is illustrated in FIGS. 5–14.

As can be seen from FIGS. 5–14, the variation of dimensionless pressure with respect to dimensionless time varies slowly for this transient pressure analysis. The variation is more perceptible from the first time derivative of the dimensionless pressure, $P_D$, taken with respect to the dimensionless time, $t_D$. Using classical theorems for the relationship between a function and its derivative in the Laplace domain, the Laplace transform of the first time derivative of the dimensionless pressure taken with respect to the dimensionless time is obtained from Equation [11] above, and is expressed as follows:

$$P_{Dw} = \left\{ \frac{K_0(x')}{x' K_1(x') + C_D' u' K_0(x')} \right\} \quad [15]$$

where x' is given by Equation [13].

Numerical inversion of Equation [15] can be performed as described above. As with the dimensionless pressure, the first time derivative of the dimensionless pressure (i.e., the first derivative of the dimensionless pressure, $P_D$, taken with respect to the dimensionless time, $t_D$) results in a second set of surfaces which, like the dimensionless pressure surfaces, can be illustrated graphically in log-log form. As with the dimensionless pressure surfaces, the surfaces of the first time derivative of the dimensionless pressure are also conveniently expressed in terms of dimensionless time and the same two groups of dimensionless parameters. Two of the resulting surfaces 44, 46 are shown schematically in FIG. 4. As with the dimensionless pressure, the first time derivative of the dimensionless pressure can also be expressed as a function of three independent variables:

$$P'_D = P'_D(t_D/C_D, C_D e^{2S}, \omega'\lambda' e^{-2S}).$$

Figure 4:
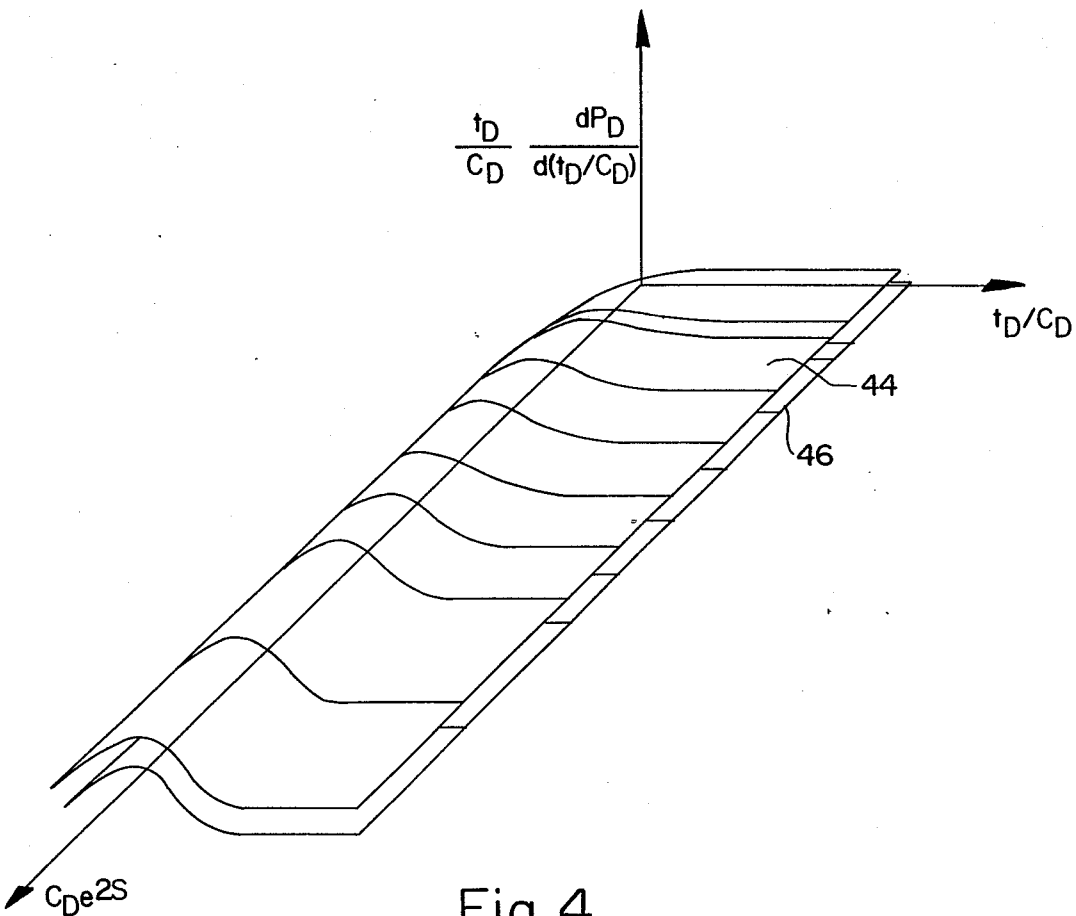
FIG. 4 is a graphical illustration of the surfaces obtained from solution of the analytical model for the first time derivative of the dimensionless pressure.
Figure 5:
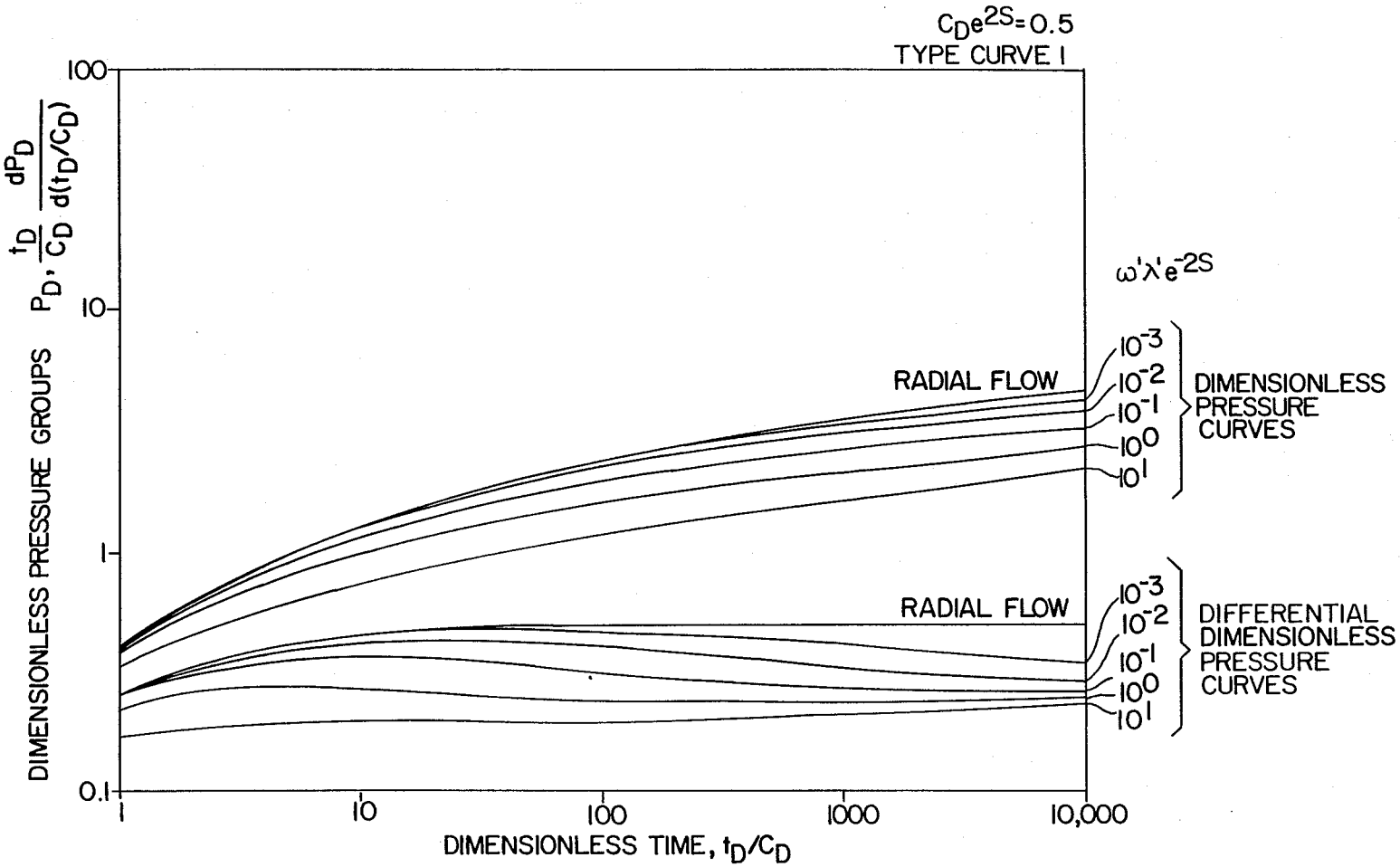
FIGS. 5 through 14 are type curves generated according to the theoretical solution.
Figure 6:
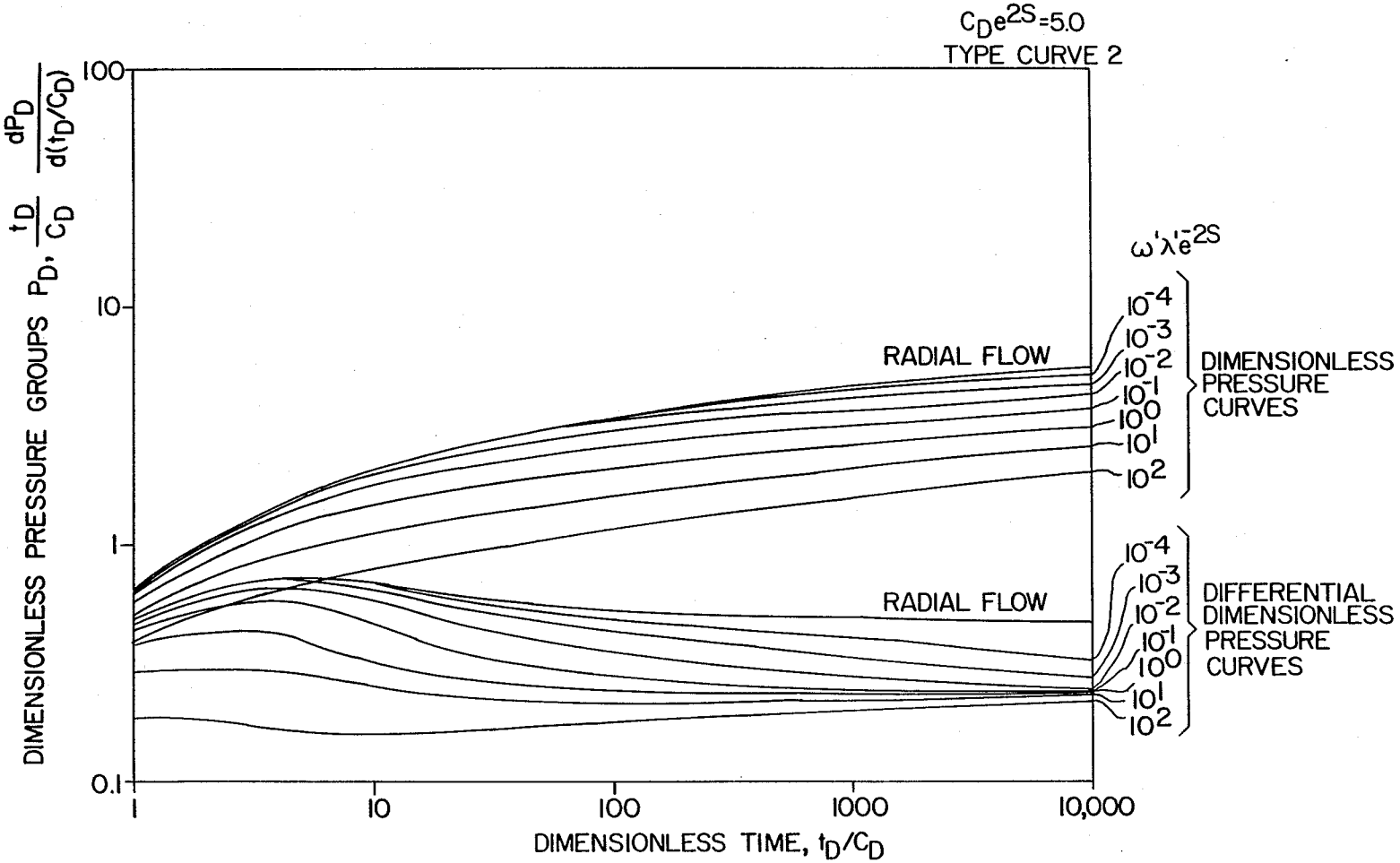
Figure 7:
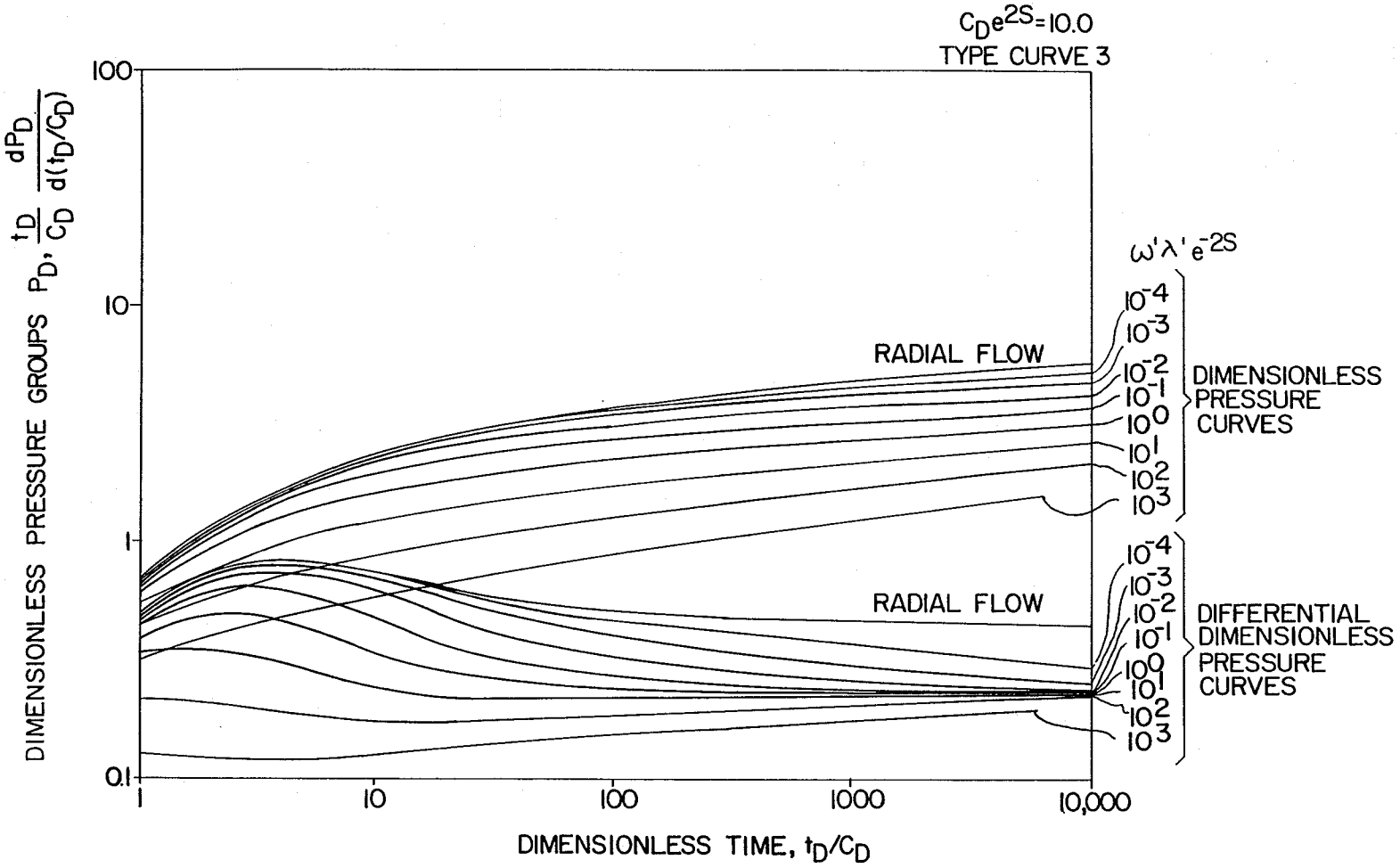
Figure 8:
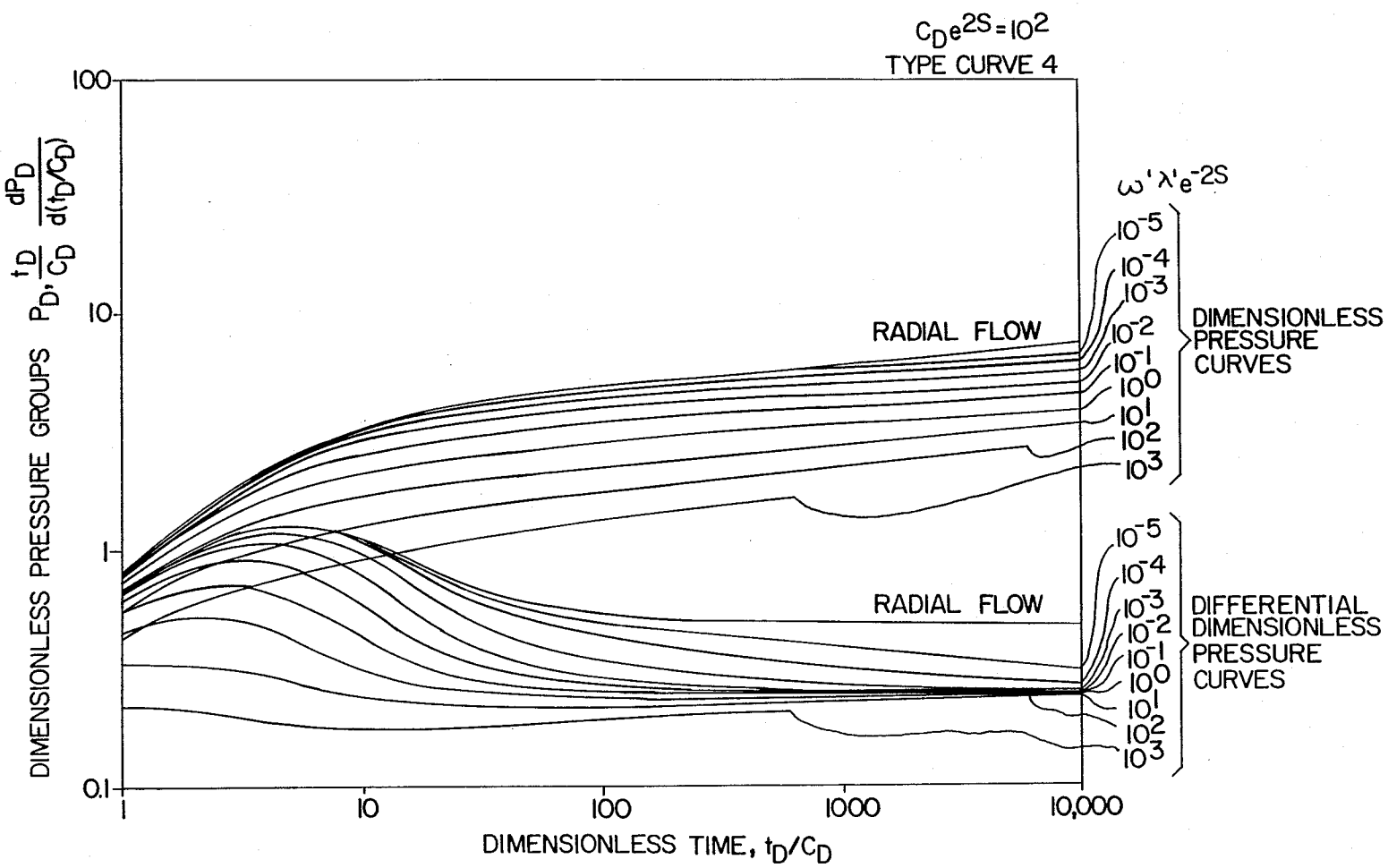
Figure 9:
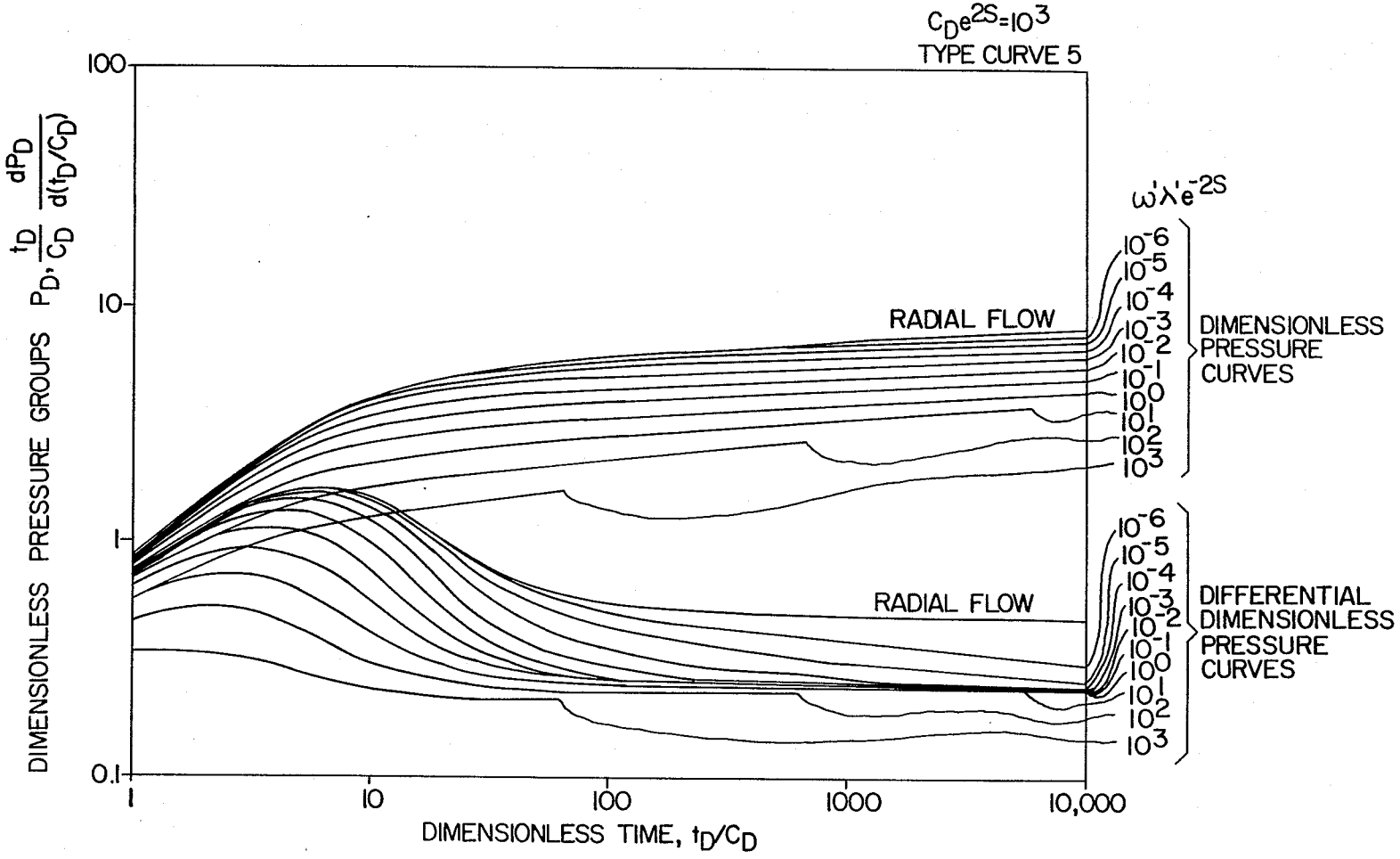
Figure 10:
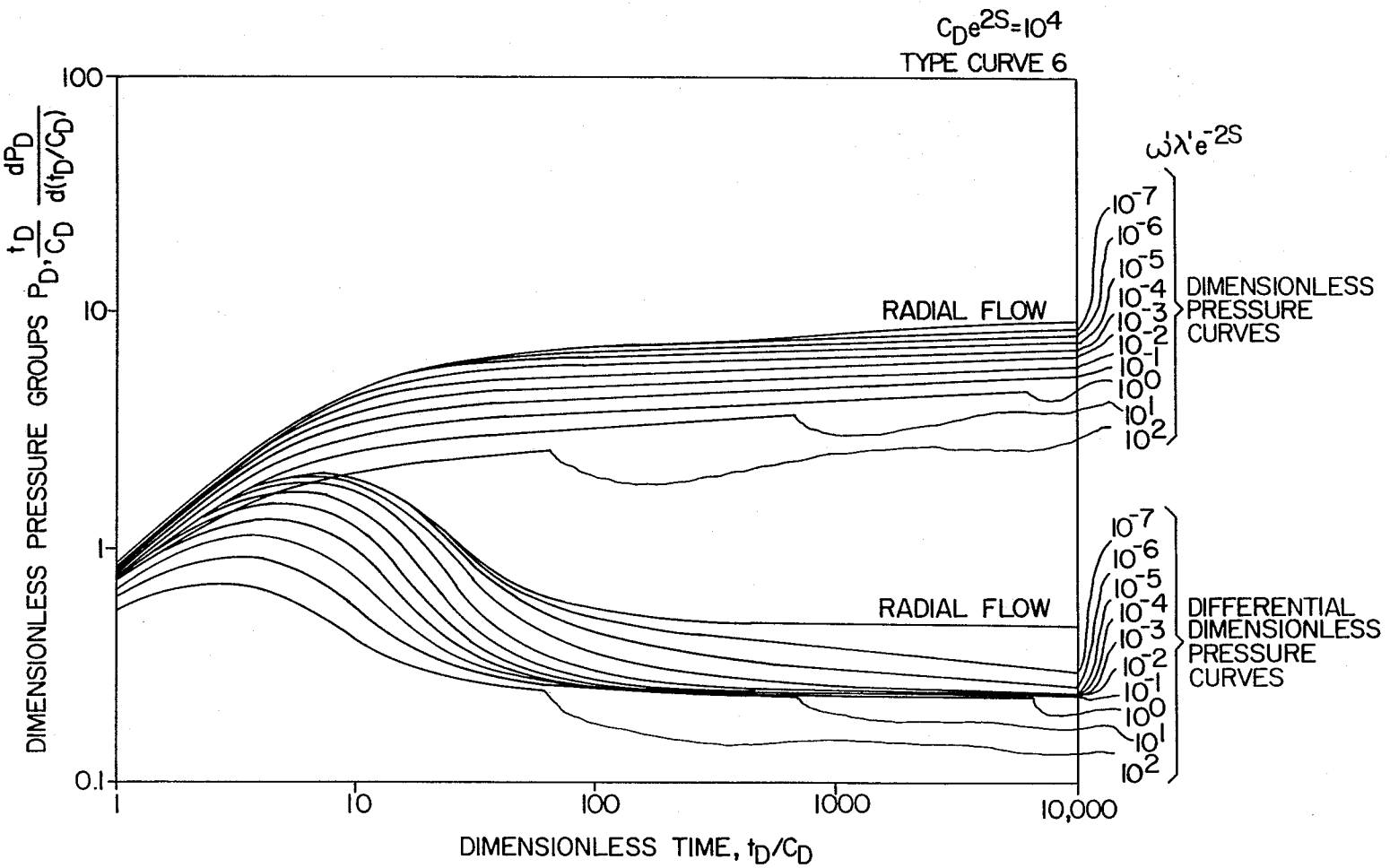
Figure 11:
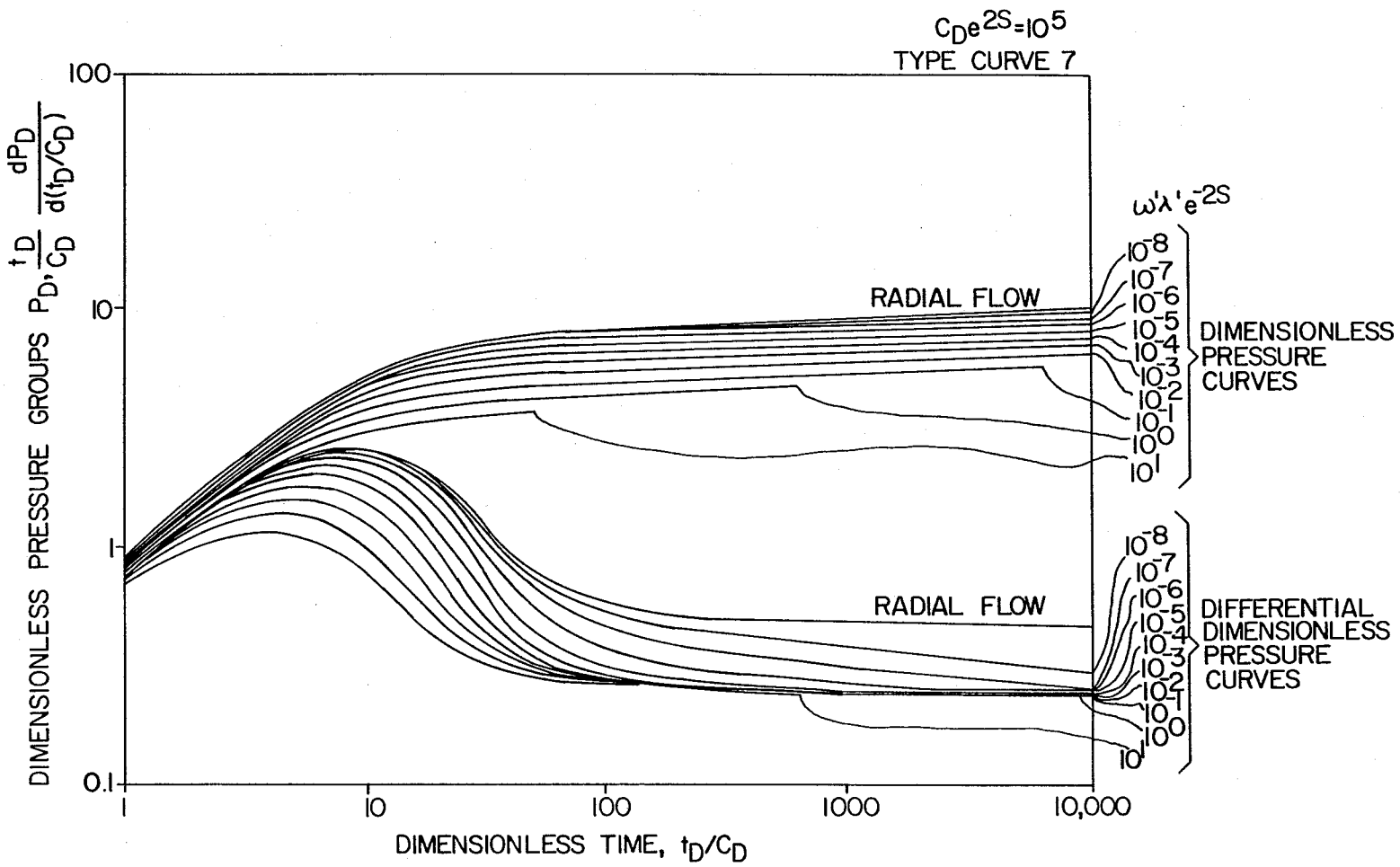
Figure 12:
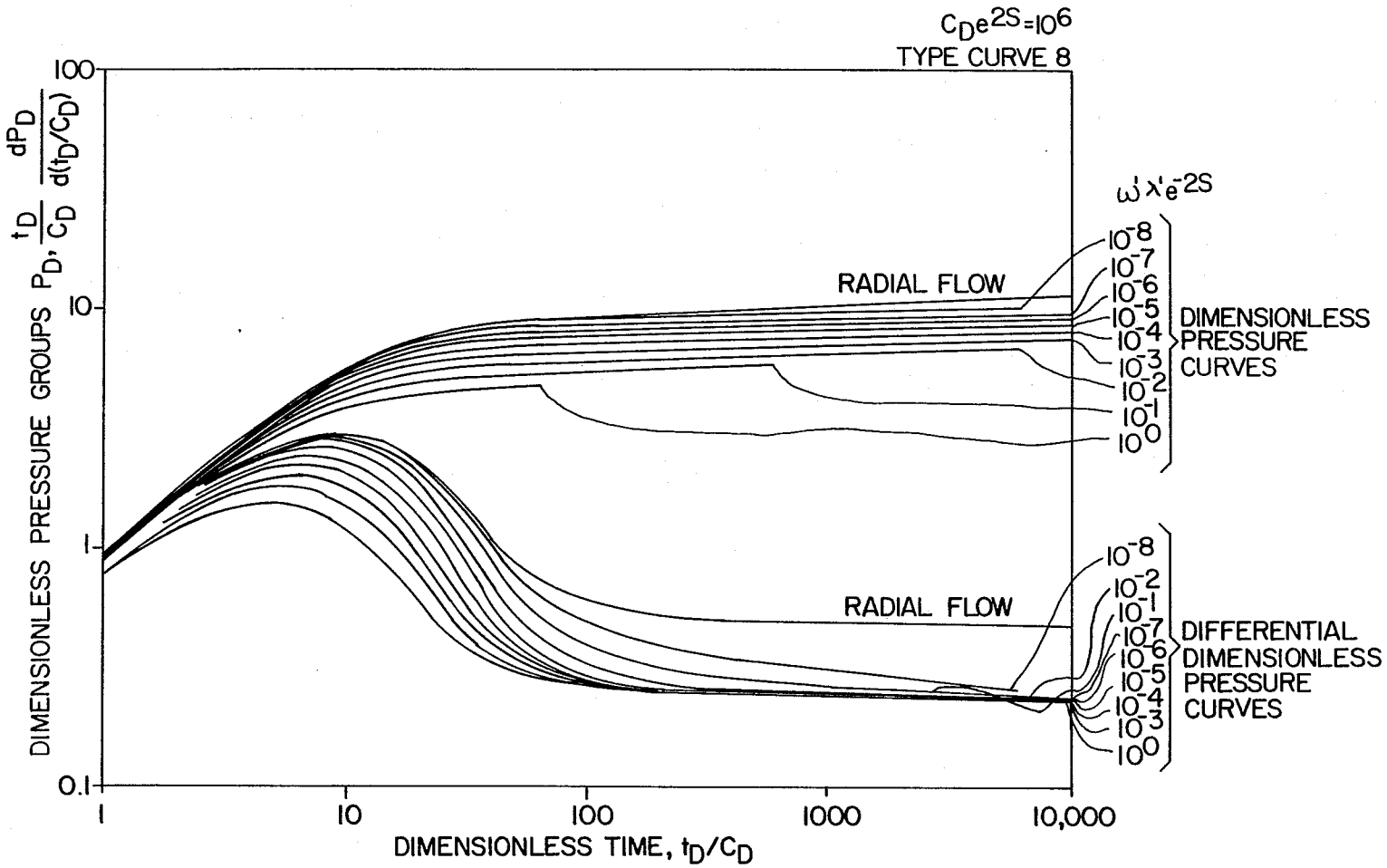
Figure 13:
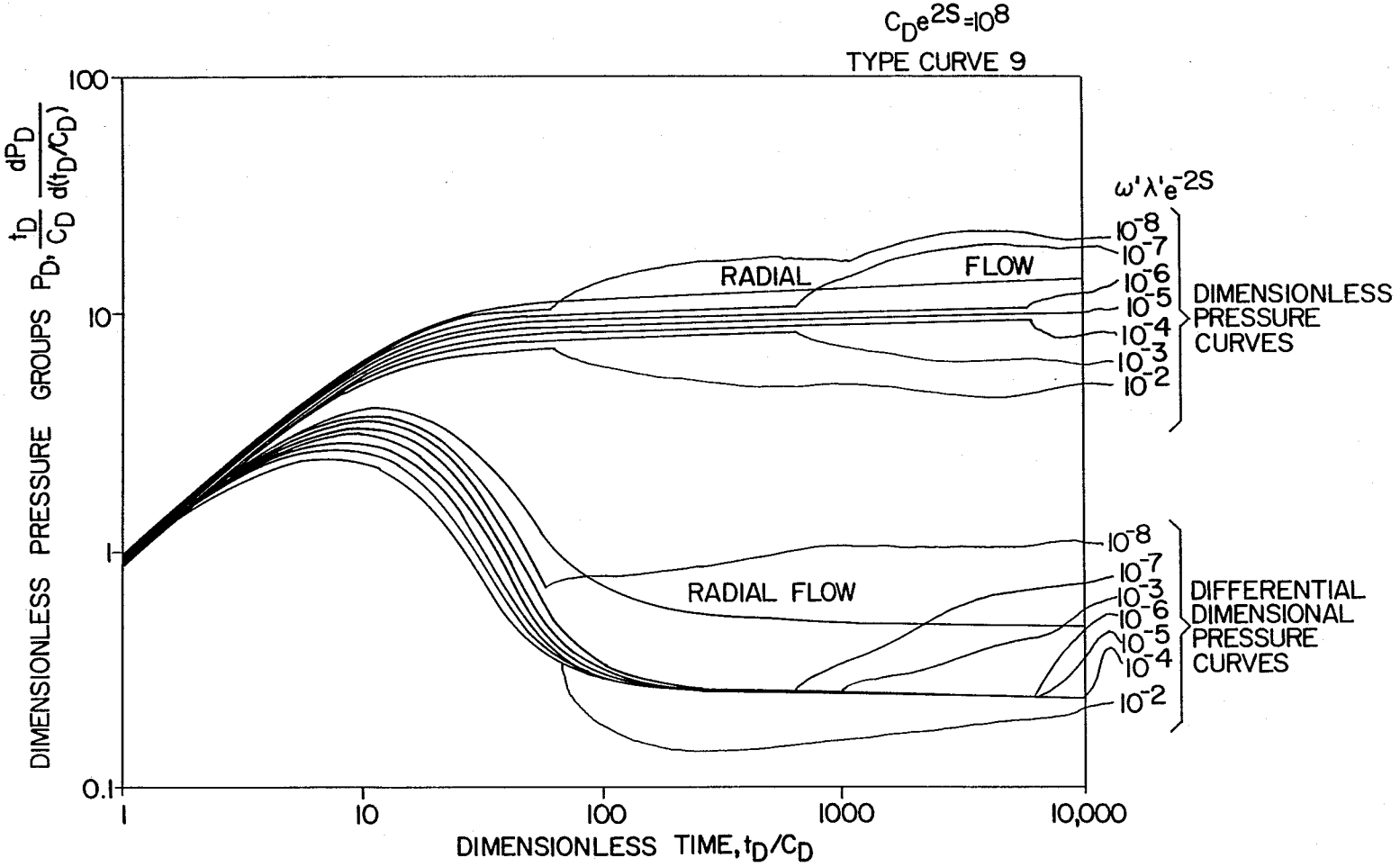
Figure 14:
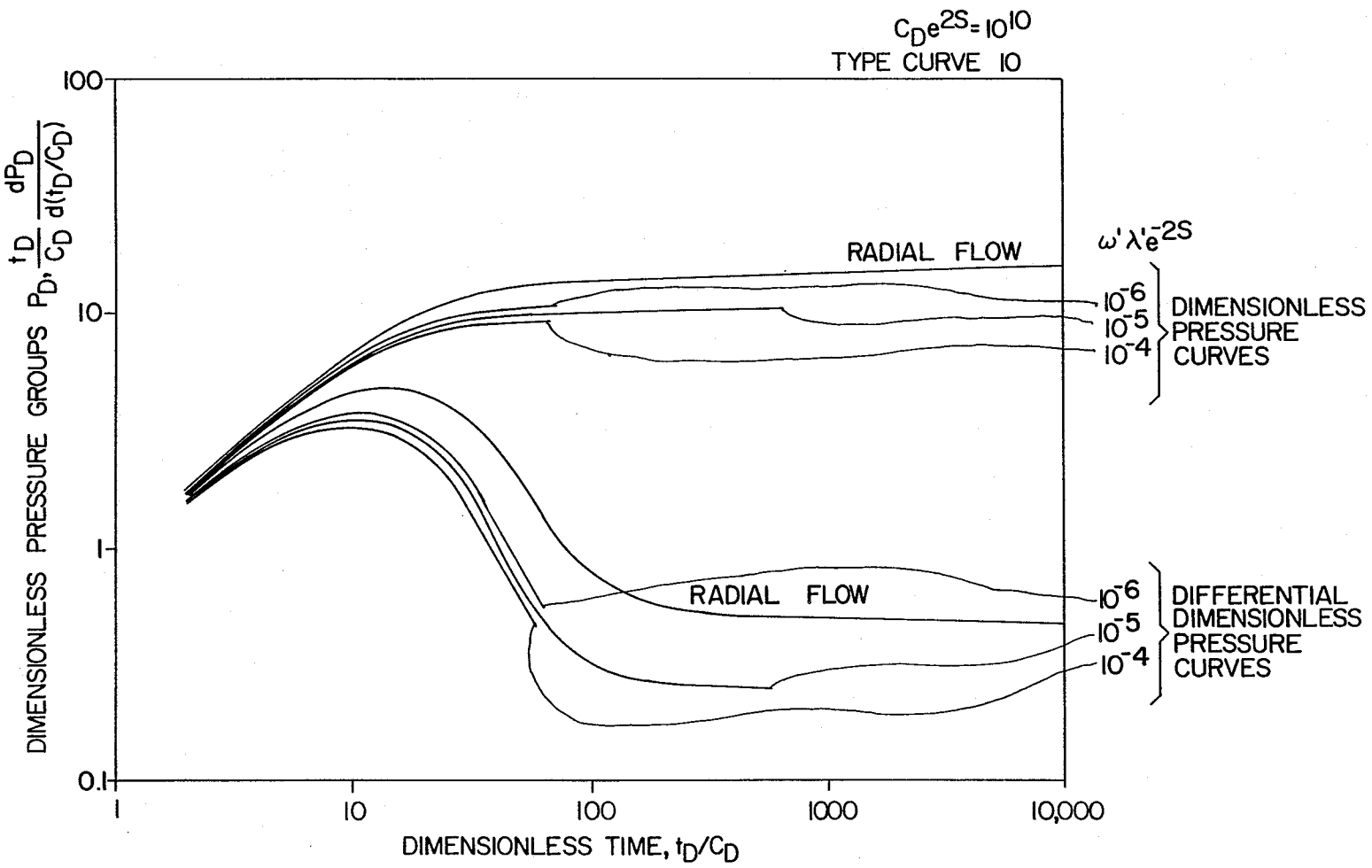

Like the dimensionless pressure, the results of this numerical inversion can also be presented as a second series of type curves which represent cross sections taken through the surfaces of FIG. 4 for constant values of the first group of dimensionless parameters with each curve having a constant value of the second dimensionless parameter group. Those cross sections are shown graphically in the type curves of FIGS. 5–14. By multiplying the inverted values of the first time derivative of the dimensionless pressure by $t_D/C_D$, the first time derivative of the dimensionless pressure is scaled to fit conveniently on the same type curve and the dimensionless pressure itself.

To use the transient behavior analytical solution of the reservoir flow equations, experimentally obtained measurements of wellbore pressure as a function of time are obtained. Where appropriate tests have already been performed, the data from those tests can be used. However, where no data is available, then it is necessary to perform an actual test on the well. The actual test performed can be a shut-in test where the well is closed to prevent flow from the well, with measurements of pressure at successive time increments being made and recorded. Alternatively, the test can be a draw-down test where the well is opened after having been shut-in for an appropriate period of time, with measurements of pressure at successive time increments being made and recorded.

In any event, after the change in flow rate is made, the wellbore pressure at the depth of the producing reservoir is sensed at the successive time increments with the results being recorded. The data may be recorded mechanically or electronically so that the result is a printed tabulation of the variation of pressure and associated time increments.

The set of experimental data thus obtained is preferably plotted on a log-log graph having cycles with the same size as cycles of the type curves. In the case of the present invention, both the first series of type curves and the second series of type curves have been presented on the same graph thereby making selection of the appropriate graph paper easy. The experimental data is plotted as pressure change, i.e., difference from a reference pressure (usually the starting pressure), as a function of time measured from the flow change, i.e., $\Delta t$. Alternatively, the pressure difference may be expressed as a function of the equivalent time, $t_{eq}$, which is defined by Agarwal in "A New Method to Account for Producing Time Effects When Drawdown Type Curves Are Used to Analyze Pressure Buildup and Other Test Data", SPE paper 9289, Sept. 21–24, 1980.

The time-rate-of-change of the experimental pressure data is calculated in a known manner and is scaled by either $\Delta t$ or $t_{eq}$, as appropriate. The time-rate-of-change of experimental pressure data is then plotted on the same log-log graph as the pressure difference data.

Figure 3:
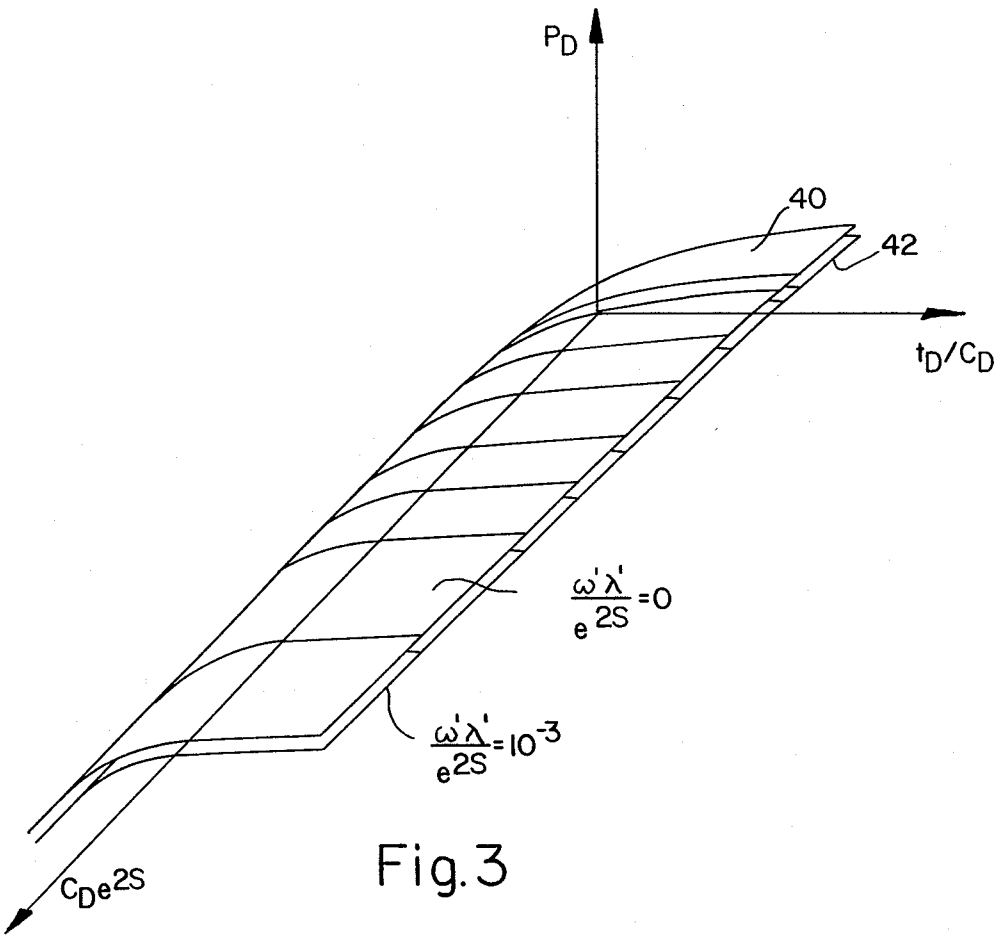
FIG. 3 is a graphical illustration of the surfaces obtained from solution of the analytical model for the dimensionless pressure.

The graph of the experimental data set is then compared with the dimensionless pressure surfaces illustrated by FIG. 3 to identify the surface having the closest match between the experimental data and the theoretical solution. During the matching process, the origin of the plane of the experimental data set is effectively moved along the axis of the parameter, $C_D e^{2S}$, such that the plane of the experimental data remains parallel to the plane defined by the axes $P_D$ and $t_D/C_D$. As the experimental data are matched to the surfaces of dimensionless pressure, the best match may be determined, for example, by a suitable conventional non-linear optimization technique. A suitably programmed digital computer can be used to accomplish the matching process, if desired. Alternatively, the graph of the experimental data set can be compared with each of the type curves of FIGS. 5–14 to obtain the closest match between the experimental data and the first series of theoretical type curves for dimensionless pressure.

At the same time that the experimental data is being matched, the second set of surfaces or the second series of theoretical type curves for the first time derivative of the dimensionless pressure can be compared with the time-rate-of-change for the experimental data. While the experimental pressure change data is matched to the first set of surfaces or the first series of type curves, the time-rate-of-change of experimental pressure is matched to the first time derivative of the dimensionless pressure on the second set of surfaces or the second series of type curves with the value of the second dimensionless group being the same on the surfaces of both the first and second set or the second dimensionless parameter group being the same on each of the type curves of the first and second series.

Figure 15:
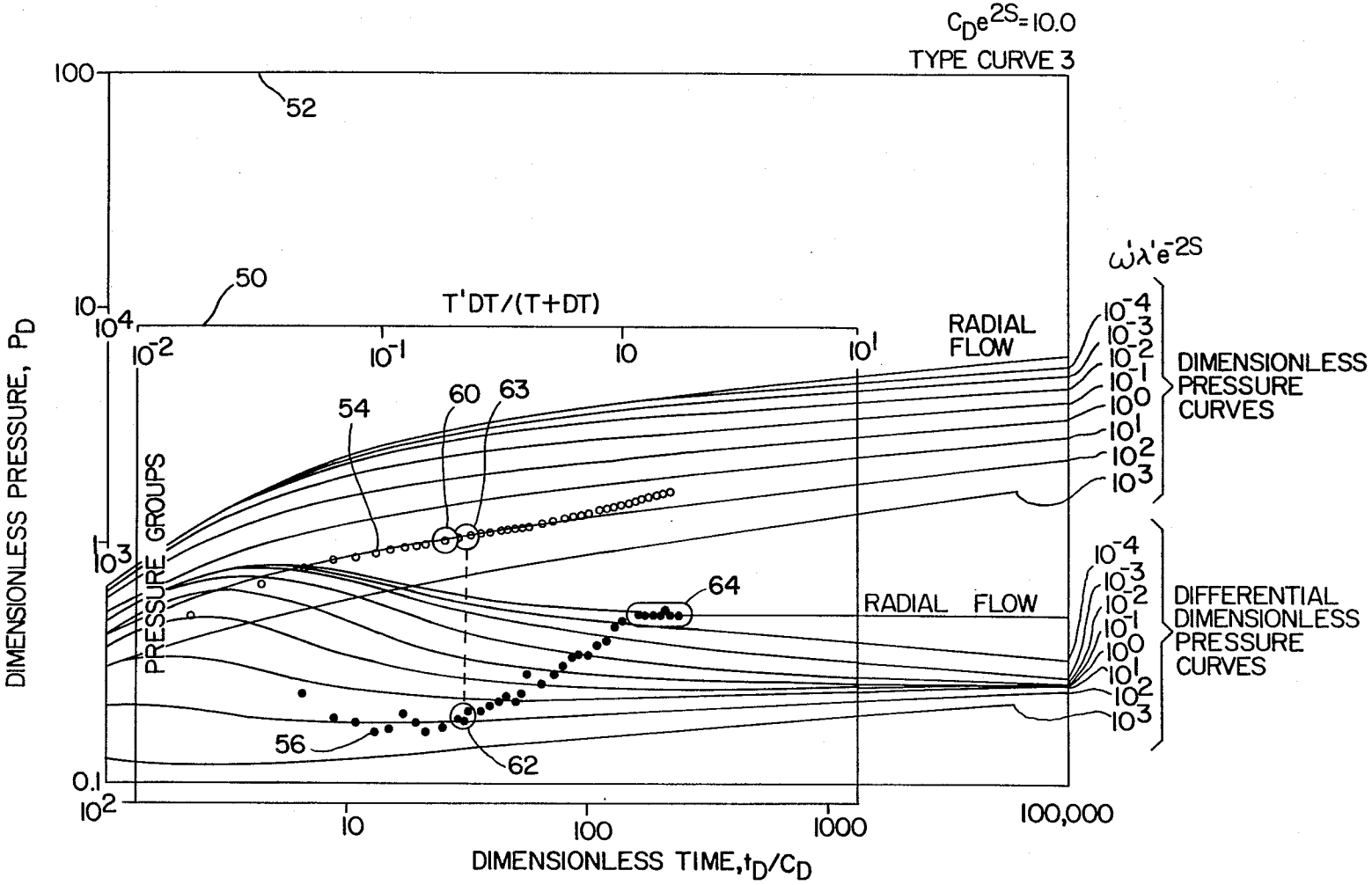
FIG. 15 illustrates a match between experimental data and a type curve.

An example of the way in which the comparison analysis would be performed using type curves of the first and second series is illustrated in FIG. 15. It will be noted that where the method is practiced using the plurality of type curves, the experimental data set as well as the type curves themselves are presented on log-log graph paper having cycles of the same size so that the experimental data can be compared to each of the type curves without being redrawn for a different cycle size or scale.

While the first condition for the comparison analysis involves matching the experimental data to the type curves for dimensionless pressure (and, if desired, to the first time derivative of dimensionless pressure), there is a second condition for the comparison analysis where the experimental data exhibits characteristics of semilog line data (see reference numeral 64 of FIG. 15). This second condition requires that the semilog line data closely corresponds to the first time derivative of dimensionless pressure for the condition of pure radial flow, i.e., the solution of Equations [11] and [14].

Now, with reference to FIG. 15, while the axes of the experimental data plot 50 are maintained parallel to the axes of the type curve 52, the graph of the experimental data set is moved around until the experimental data points prior to the end 63 of the transition period correspond closely to one of the dimensionless pressure curves for a given value of $\omega'\lambda'e^{-2S}$. Similarly, only time-rate-of-change data prior to the end 62 of the transition period will correspond closely to this first time derivative of dimensionless pressure. In the matching procedure, the time-rate-of-change data must also match the first time derivative of dimensionless pressure for the same value of $\omega'\lambda'e^{-2S}$. Since the experimental data also exhibits semilog line data characteristics 64, the time-rate-of-change data having the semilog line data characteristics must meet the second condition discussed above, namely the data must correspond closely with the first time derivative of dimensionless pressure curve for pure radial flow.

Having obtained the curve match, a match point 60 is selected for the experimental data and for the dimensionless pressure type curve. The match point may be any arbitrary point on the overlapping portions of the graph of experimental data and the graph of the dimensionless pressure type curve, with the match point on the experimental data plot directly overlying the corresponding match point on the dimensionless pressure curve of the type curve chart. It is not required that the match point be selected in any particular part of the overlapping portions, for example, it is not restricted to being on a particular type curve line.

The selected match point 60 determines a dimensionless pressure from the type curve domain and a corresponding experimental pressure difference from the experimental data plot domain. The transmissibility, $kh/\mu$, can be evaluated from a known relationship between the dimensionless pressure and the pressure difference, e.g., from the classical definition of the dimensionless pressure:

$$P_D = \frac{k\,h}{141.2\,\mu q B}\,\Delta P \qquad [16]$$

where: $P_D$ is the dimensionless pressure taken at the match point; $\Delta P$ is the experimental pressure difference at the match point;

k is the effective permeability of the formation;

h is the thickness of the formation;

q is the production rate of the formation;

B is the formation volume factor; and $\mu$ is the fluid viscosity for the fluid being produced.

When solving Equation [16], the production rate of the formation is taken from the experimental data corresponding to the particular pressure difference used, the formation volume factor is known from tests conducted during PVT testing or from correllations, and the fluid viscosity may be known from tests conducted, for example, during drilling.

If the fluid viscosity is known from other conventional tests, then Equation [16] can be solved for the flow capacity, kh. Moreover, if the thickness of the formation is also known from well logs, such as those made during drilling, or from other observations, Equation [16] can also be solved for the effective permeability, k.

At the selected match point, corresponding values of the ratio of dimensionless time to dimensionless wellbore storage coefficient, $t_D/C_D$, and elapsed time since the beginning of the test, $\Delta t$, are also determined by the experimental data plot and the type curve. The wellbore storage constant, C, can be determined from the classical equation for the definition of the ratio of dimensionless time to dimensionless wellbore storage coefficient:

$$t_D/C_D = 0.000295\ kh/\mu\Delta t/C \qquad [17]$$

where:

$t_D/C_D$ is the ratio of dimensionless time to dimensionless wellbore storage coefficient at the match point;

$\Delta t$ is the elapsed time in the experimental data taken at the match point;

k is the effective permeability of the formation which is determined as described above;

h is the thickness of the formation determined from the well logs, such as at the time of drilling, or other observations;

$\mu$ is the fluid viscosity which may be determined, for example, at the time of drilling; and C is the wellbore storage constant for the particular well.

Alternatively, the wellbore storage constant, C, can be determined from Equation [17] where the classical expression of equivalent time, t', is substituted for $\Delta t$ and where $t' = t\,\Delta t/(t+\Delta t)$.

Next, the dimensionless wellbore storage coefficient, $C_D$, can be ascertained from the classical definition of that coefficient:

$$C_D = 0.8936\,\frac{C}{r_w^2\,h\,\phi\,C_t} \qquad [18]$$

where:

C is the wellbore storage constant, determined above;

$r_w$ is the wellbore radius which is known from the drilling operation;

h is the thickness of the formation determined from well logs or other observations;

$\phi$ is the connected porosity which is known from tests on rock samples, such as those tests conducted during drilling; and $c_t$ is the total system compressibility.

From the type curve providing the closest match to the experimental data, a value for the expression $C_De^{2S}$ is known. Since $C_D$ itself has been determined, the expression $C_De^{2S}$ can readily be solved for the skin factor, S.

It is known from Serra et al, "New Pressure Transient Analysis Methods for Naturally Fractured Reservoirs", *J. Petroleum Technology* (Dec. 1983) 2271–83, that at the transition from the transition period to late time radial flow, the dimensionless time evaluated at the end of the transition period, $(t_D)_{et}$, can be expressed as follows:

$$(t_D)_{et} = 0.63 \frac{\omega'}{\lambda'} \quad [19]$$

where:

$\omega'$ is the dimensionless storativity ratio; and $\lambda'$ is the dimensionless fracture transfer coefficient.

Equation [19] can be rearranged as follows so that the dimensionless fracture transfer coefficient can be determined from known quantities:

$$\lambda' = e^S \sqrt{0.63\,(\omega'\lambda'\,e^{-2S})_{curve}/[C_D\,(t_D/C_D)_{et}]} \quad [20]$$

where:

$(\omega'\lambda^{-2S})_{curve}$ is the value for the type curve of dimensionless pressure which most closely matches the experimental data;

$(t_D/C_D)_{et}$ is the value of the ratio of dimensionless time to dimensionless wellbore storage coefficient at the point 62 where the first time derivative of the dimensionless pressure departs from the type curve;

$C_D$ is the dimensionless wellbore storage coefficient; and

S is skin factor.

Using the parameter $(\omega'\lambda'e^{-2S})_{curve}$ for the curve which matches the experimental data, the values for the dimensionless fracture transfer coefficient, and the skin factor, the dimensionless storativity ratio can be determined.

It will, of course, be apparent that when the experimental data is compared to the type curves, there may be more than one value of $C_De^{2S}$ for which there appears to be a close match between the experimental data and the type curves. In order to discriminate between these competing type curves to ascertain which type curve is actually the best match, the following relationship is used to evaluate how closely the dimensionless pressure is related to the expected change in the dimensionless pressure in the long time radial flow period for an underground reservoir:

$$P_D = \tfrac{1}{2} n\,(1+\omega') \quad [21]$$

where $\omega'$ is the dimensionless storativity ratio. The calculated value for the dimensionless pressure change for each of the competing type curves is then compared with the dimensionless pressure change found on the corresponding type curve. The type curve having the closest agreement between the calculated value of the dimensionless pressure change and the actual dimensionless pressure change is the correct choice.

Accordingly, it will now be seen that from evaluations following a simple type curve comparison, the effective permeability, the dimensionless fracture transfer coefficient, the skin factor, the dimensionless wellbore storage coefficient, and the dimensionless storativity ratio for the underground reservoir can all be determined. Those calculations can be performed by hand or through the use of a suitably programmed digital computer.

It will now be apparent that the method described above permits analysis of underground formation characteristics by use of a transient analysis. Moreover, it will be apparent to those skilled in the art that numerous modifications, variations, substitutions, and equivalents exist for the various features of the claimed invention. Accordingly, it is expressly intended that all such modifications, variations, substitutions, and equivalents for features of the invention which fall within the spirit and scope of the invention as defined by the appended claims be embraced by those claims.

What is claimed is:

1. A method of determining characteristics of an underground reservoir formation having a well communicating therewith comprising the steps of:

obtaining a theoretical solution representing the variation of dimensionless wellbore pressure during an early time radial flow period and a transition flow period in the underground reservoir as a function of (a) the ratio of dimensionless time to dimensionless wellbore storage coefficient, $t_D/C_D$, (b) a first parameter $C_De^{2S}$, and (c) a second parameter $\omega'\lambda'e^{-2S}$, the theoretical solution being based on the early time radial flow period and the transition period flow of a dual porosity isotropic uniform thickness reservoir exhibiting wellbore storage and skin effects;

varying, at a predetermined time, a flow area of a valve passage through which fluid from a wellbore flows;

detecting and recording a variation of wellbore pressure at the underground reservoir formation as a function of time measured from the variation of wellbore flow area to thereby obtain an experimental data variation;

comparing the experimental data variation to the theoretical solution to determine which values of the first parameter and the second parameter correspond to the experimental data variation;

selecting a match point on the experimental data variation and the corresponding theoretical surface;

using the selected match point and the dimensionless time corresponding to the end of the transition period to determine at least one of the following characteristics of the underground formation:

flow capacity, kh, effective permeability, k, transmissibility, $kh/\mu'$ wellbore storage constant, C, dimensionless wellbore storage coefficient, $C_D$, dimensionless fracture transfer coefficient, $\lambda$ or $\lambda'$, and dimensionless storativity ratio, $\omega$ or $\omega'$; and recording the detected variation of wellbore pressure and the at least one determined characteristic of the underground formation.

2. A method of determining characteristics of an underground reservoir formation having a well communicating therewith comprising the steps of:

obtaining a first set of theoretical surfaces representing the variation of dimensionless wellbore pressure during an early time radial flow period and a transition flow period in the underground reservoir, the theoretical surfaces being expressed as a function of dimensionless time and as a function of the parameter $C_De^{2S}$, each theoretical surface of dimensionless wellbore pressure having a constant value of a second parameter $\omega'\lambda'^{-2S}$, the theoretical surfaces being based on the early time radial flow period and the transition period flow of a dual porosity isotropic uniform thickness reservoir exhibiting wellbore storage and skin effects;

varying, at a predetermined time, a flow area of a valve passage through which fluid from a wellbore flows;

detecting and recording a variation of wellbore pressure at the underground reservoir formation as a function of time measured from the variation of wellbore flow area to thereby obtain an experimental data variation;

comparing the experimental data variation to the theoretical surfaces to determine which theoretical surface corresponds to the experimental data variation;

determining from the comparison step the dimensionless time corresponding to the end of the transition period;

selecting a match point on the experimental data variation and the corresponding theoretical surface;

using the selected match point and the dimensionless time corresponding to the end of the transition period to determine at least one of the following characteristics of the underground formation:

flow capacity, kh, effective permeability, k, transmissibility, $kh/\mu'$ wellbore storage constant, C, dimensionless wellbore storage coefficient, $C_D$, dimensionless fracture transfer coefficient, $\lambda$ or $\lambda'$, and dimensionless storativity ratio, $\omega$ or $\omega'$; and recording the detected variation of wellbore pressure and the at least one determined characteristic of the underground formation.

3. The method of claim 2 wherein the step of obtaining a first set of theoretical surfaces includes the step of basing the theoretical surfaces on an early time radial flow period and a transition period unsteady-state flow.

4. The method of claim 2 wherein the step of obtaining a first set of theoretical surfaces includes the step of basing the theoretical surfaces on an early time radial flow period and a transition period pseudo-steady state flow.

5. A method of determining characteristics of an underground reservoir formation having a well communicating therewith comprising the steps of:

obtaining a set of experimental data for a well to be analyzed, the experimental data including variation of wellbore pressure as function of time measured from a change in wellbore flow area;

obtaining a first set of theoretical surfaces representing the variation of the dimensionless wellbore pressure using an early time radial and a transition period approximation of the transient behavior of the underground reservoir, the theoretical surfaces being expressed as a function of dimensionless time and as a function of the parameter $C_De^{2S}$, each theoretical surface of dimensionless wellbore pressure having a constant value of a second parameter $\omega'\lambda'e^{-2S}$, the theoretical surfaces being based on the early time radial and the transition period for an unsteady-state flow in a naturally fractured isotropic uniform thickness reservoir exhibiting wellbore storage and skin effects;

comparing the experimental data variation to the theoretical surfaces to determine which theoretical surface corresponds to the experimental data variation;

determining from the comparison step the dimensionless time corresponding to the end of the transition period;

selecting a match point on the experimental data variation and the corresponding theoretical surface; and using the selected match point and the dimensionless time corresponding to the end of the transition period to determine at least one of the following characteristics of the underground formation:

flow capacity, kh, effective permeability, k, transmissibility, $kh/\mu$, wellbore storage constant, C, dimensionless wellbore storage coefficient, $C_D$, dimensionless fracture transfer coefficient, $\lambda$ or $\lambda'$, and dimensionless storativity ratio, $\omega$ or $\omega'$.

6. The method of claim 5 including the further steps of:

converting the experimental data set to obtain a time-rate-of-change of the experimental data which varies with respect to time;

obtaining a second set of theoretical surfaces representing the variation of a function of the first time derivative of the dimensionless wellbore pressure during the early time radial and transition period approximation, the theoretical surfaces being expressed as a function of dimensionless time and as a function of the parameter $C_De^{2S}$, each of the second set of theoretical surfaces having a constant value of the second parameter $\omega'\lambda'e^{-2S}$, the theoretical surfaces the second set being based on the transient flow period for an unsteady flow in a naturally fractured isotropic uniform thickness reservoir exhibiting wellbore storage and skin effects; and comparing the time-rate-of-change of the experimental data set to the second set of theoretical surfaces at the same time that the first set of surfaces are compared to the experimental pressure data set to improve the discrimination between the various constant values for the surfaces and to augment selection of the end of the transient flow period.

7. The method according to claim 6 further including the step of determining the value for the dimensionless time at the end of the transition flow period from the comparison of the time-rate-of-change of the experimental data set to the second set of theoretical surfaces.

8. The method according to claim 5 wherein the first set of surfaces is represented by a series of type curves, each of which corresponds to a cross section taken through the first set of surfaces for a corresponding value of the parameter $C_De^{2S}$, and wherein the comparison step includes the step of matching a curve of the experimental data set to each of the type curves, and selecting as the best match the type curve for which the dimensionless wellbore pressure for the type curve compares most favorably with the shape of the early time radial and transition period approximation portion of the experimental data set.

9. The method according to claim 6 wherein the second set of surfaces is represented by a second series of type curves, each of which corresponds to a cross section taken through the second set of surfaces for a corresponding value of the parameter $c_De^{2S}$, and wherein the comparison step includes the step of matching a second curve of the time-rate-of-change of the experimental data set to the second series of type curves, and selecting as the best match the type curve for which the first and second series of type curves compare most closely with the experimental data and for which the dimensionless wellbore pressure compares most favorably with the dimensionless wellbore pressure calculated for the late time radial flow period.

10. The method of claim 5 wherein, during the comparison step, the logarithm of the variation of wellbore pressure expressed as a function of the logarithm of time measured from the change in wellbore flow area is compared with the first set of theoretical surfaces, where the first set of theoretical surfaces represent the variation of the logarithm of the dimensionless wellbore pressure, expressed as a function of the logarithm of dimensionless time and as a function of the logarithm of the parameter $C_De^{2S}$.

11. The method of claim according to claim 10 wherein the first set of surfaces is represented by a series of type curves, each of which corresponds to a cross section taken through the first set of surfaces for a corresponding value of the parameter $C_De^{2S}$, and wherein the comparison step includes the step of matching a first graph of the experimental data set to each of the type curves, and selecting as the best match the type curve for which the dimensionless wellbore pressure compares most favorably with the shape of the early time radial and transition period approximation portion of the data.

12. The method of claim 6 wherein, during the comparison step, the logarithm of the variation of the time-rate-of-change of the wellbore pressure expressed as a function of the logarithm of time measured from the change in wellbore flow area is compared with the second set of theoretical surfaces, where the second set of theoretical surfaces represent the variation of the logarithm of the first time derivative of the dimensionless wellbore pressure, expressed as a function of the logarithm of dimensionless time and as a function of the logarithm of the parameter $C_De^{2S}$.

13. The method according to claim 11 wherein the second set of surfaces is represented by a second series of type curves, each of which corresponds to a cross section taken through the second set of surfaces for a corresponding value of the parameter $C_De^{2S}$, and wherein the comparison step includes the step of matching a second graph of the time-rate-of-change of the experimental data set to the second series of type curves, and selecting as the best match the type curve for which the first and second series of type curves compare most closely with the experimental data and for which the dimensionless wellbore pressure compares most favorably with the shape of the early time radial and transition period approximation portion of the data.

14. The method of claim 13 wherein a convenient match point is selected where the experimental data set overlies the first series of type curves, wherein a dimensionless pressure and an experimental pressure difference are determined at the match point, wherein (a) fluid production rate, q, and (b) formation volume factor, B, are known for the well being analyzed, and wherein the formation transmissibility, $kh/\mu$, is determined from the following relationship:

$$P_D = \frac{(k\,h)}{141.2\ \mu q B}\ \Delta P.$$

15. The method of claim 14 wherein the first series of type curves and the second series of type curves are plotted versus the ratio of dimensionless time to dimensionless wellbore storage coefficient, $t_D/C_D$, wherein a ratio of dimensionless time to dimensionless wellbore storage coefficient, $t_D/C_D$, and a corresponding value of elapsed time in the experimental data set are obtained from the match point, and wherein the wellbore storage constant, C, is determined from the following relationship:

$$t_D/C_D 0.000295\ kh/\mu\Delta t/C,$$

where $\Delta t$ represents incremental time.

16. The method according to claim 15, wherein (a) total compressibility, $c_t$, (b) wellbore radius, $r_w$, (c) porosity fraction, $\phi$, and (d) formation thickness, h, are known for the well being analyzed, and wherein the wellbore storage coefficient, $C_D$, is determined from the following relationship:

$$C_D = 0.8936\,\frac{C}{r_w^2\ h\ \phi\ C_t}.$$

17. The method according to claim 16 wherein the parameter $C_De^{2S}$ have a value, Z, which is taken from the type curve series on which the match point is located, and wherein the skin factor, S, is determined from the following relationship:

$$C_De^{2S}=Z.$$

18. The method according to claim 17 wherein the ratio of dimensionless time to dimensionless wellbore storage coefficient at the end of the transition flow regime, $(t_D/C_D)_{et}$, is selected by observing where the time-rate-of-change of the experimental data set departs from the first time derivative of the dimensionless wellbore pressure, wherein the second parameter $(\omega'\lambda'e^{-2S})_{curve}$, corresponds to the type curve of the first series which provides the best match for the experimental data set, and wherein dimensionless fracture transfer coefficient is determined from the relationship:

$$\lambda' = e^S\sqrt{0.63\ \ (\omega'\lambda'\ e^{-2S})_{curve}/[C_D\ (t_D/C_D)_{et}]}\ .$$

19. The method of claim 18 wherein the dimensionless storativity ratio is determined from the value of the second parameter, $(\omega'\lambda'e^{-2S})_{curve}$, on the type curve of the first series for which the experimental data best matches the type curve of the first series.

20. The method of claim 14 wherein the first series of type curves and the second series of type curves are plotted versus the ratio of dimensionless time to dimensionless wellbore storage coefficient, $t_D/C_D$, wherein a ratio of dimensionless time to dimensionless wellbore storage coefficient, $t_D/C_D$, and a corresponding value of elapsed time in the experimental data set are obtained from the match point, and wherein the wellbore storage constant, C, is determined from the following relationship:

$$t_D/C_D=0.000295\ kh/\mu t'/C,$$

where t' represents an equivalent time determined according to the equation:

$t' = t\Delta t/(t+\Delta t)$.

21. The method of claim 13 wherein a convenient match point is selected where the experimental data set overlies the first series of type curves, wherein a dimensionless pressure and an experimental pressure difference are determined at the match point, wherein (a) fluid production rate, q, (b) formation volume factor, B, and (c) fluid viscosity, $\mu$, are known for the well being analyzed, and wherein the formation flow capacity, kh, is determined from the following relationship:

$$P_D = \frac{(k\,h)}{141.2\ \mu q B}\ \Delta P.$$

22. The method of claim 13 wherein a convenient match point is selected where the experimental data set overlies the first series of type curves, wherein a dimensionless pressure and an experimental pressure difference are determined at the match point, wherein (a) formation thickness, h, (b) fluid production rate, q, (c) formation volume factor, B, and (d) fluid viscosity, $\mu$, are known for the well being analyzed, and wherein the effective permeability, k, is determined from the following relationship:

$$P_D = \frac{(k\,h)}{141.2\ \mu q B}\ \Delta P.$$

* * * * *

UNITED STATES PATENT AND TRADEMARK OFFICE

CERTIFICATE OF CORRECTION

PATENT NO. : 4,797,821

DATED : January 10, 1989

INVENTOR(S) : Kevin R. Petak et al

It is certified that error appears in the above-identified patent and that said Letters Patent is hereby corrected as shown below:

In column 1, line 46, the word "takn" should read -- taken--.

In column 4, line 39, the word "thos" should read --those--.

In column 8, line 47, the word "xpressed" should read --expressed--.

In column 15, line 44, the formula "$P_D = 1/2\ n\ (1 + \omega')$" should read --$P_D = 1/2\ \ln\ (1 + \omega')$--.

In column 20, line 12, the formula " $t_D/C_D 0.000295\ kh/\mu\ \Delta t/C$," should read --$t_D C_D = 0.000295\ kh/\mu\ \Delta t/C$,--.

Signed and Sealed this

Twenty-sixth Day of December, 1989

*Attest:*

JEFFREY M. SAMUELS

*Attesting Officer* *Acting Commissioner of Patents and Trademarks*